US009226543B2

(12) United States Patent
Campbell

(10) Patent No.: US 9,226,543 B2
(45) Date of Patent: Jan. 5, 2016

(54) TRANSFORMING SHOE WITH ROTATING, SLIDING; AND PIVOTING PANELS

(71) Applicant: Shirlene Andrea Campbell, Sunrise, FL (US)

(72) Inventor: Shirlene Andrea Campbell, Sunrise, FL (US)

( * ) Notice: Subject to any disclaimer, the term of this patent is extended or adjusted under 35 U.S.C. 154(b) by 60 days.

(21) Appl. No.: 13/999,718

(22) Filed: Mar. 15, 2014

(65) Prior Publication Data

US 2015/0257474 A1 Sep. 17, 2015

(51) Int. Cl.
*A43B 3/24* (2006.01)
*A43B 3/00* (2006.01)

(52) U.S. Cl.
CPC ..... *A43B 3/242* (2013.01); *A43B 3/0036* (2013.01)

(58) Field of Classification Search
CPC ..... A43B 3/24; A43B 3/242; A43B 3/0036
USPC ..... 36/100, 101
See application file for complete search history.

(56) References Cited

U.S. PATENT DOCUMENTS 2,356,490 A * 8/1944 Crotty ..... A43B 3/02 36/3 A
2,686,376 A * 8/1954 Burkholz ..... A43B 3/02 36/101
3,177,596 A * 4/1965 Siger ..... A43B 3/00 36/100
3,192,651 A * 7/1965 Smith ..... A43B 3/24 36/105
4,103,440 A * 8/1978 Lawrence ..... A43C 11/12 36/101
4,638,579 A * 1/1987 Gamm ..... A43B 3/0031 2/247
5,481,814 A * 1/1996 Spencer ..... A43B 11/00 36/103
6,594,921 B2 * 7/2003 Laio ..... A43B 3/24 36/105
2008/0022558 A1 * 1/2008 Kaufer ..... A43B 3/0031 36/100
2008/0047167 A1 * 2/2008 Pawlus ..... A43B 3/0047 36/101
2008/0072451 A1 * 3/2008 Mizrahi ..... A43B 1/0045 36/2.6
2008/0072453 A1 * 3/2008 Mizrahi ..... A43B 1/0045 36/44
2008/0201988 A1 * 8/2008 Mattia ..... A43B 3/244 36/101
2008/0235992 A1 * 10/2008 Stefani ..... A43B 3/24 36/101
2008/0289222 A1 * 11/2008 Candrian ..... A43B 1/0027 36/101
2009/0056168 A1 * 3/2009 Tseng ..... A43B 3/24 36/100
2009/0071037 A1 * 3/2009 Foxen ..... A43B 7/20 36/89
2010/0018079 A1 * 1/2010 Albert ..... A43B 3/122 36/101
2014/0165425 A1 * 6/2014 Byam ..... A43B 1/0081 36/100
2014/0298686 A1 * 10/2014 Baum ..... A43B 1/0027 36/100
2015/0000160 A1 * 1/2015 Giraldo ..... A43B 3/244 36/101
2015/0223568 A1 * 8/2015 Ortner ..... A43B 23/24 36/48

* cited by examiner

*Primary Examiner* — Khoa Huynh
*Assistant Examiner* — Jocelyn Wu

(57) ABSTRACT

A multi-functional transforming shoe that can be taken apart and reassembled in a high-top shoe configuration, a low-top shoe configuration, and an open-back configuration with a strap attachment. The transforming shoe comprises rotating, sliding, and pivoting panels which are configured using attachment means such as snaps, hook-and-loop fasteners, and rod axles. The assembly of different shoe attachments and panels provides for multiple arrangements and designs, allowing the user to switch from one style to another.

18 Claims, 92 Drawing Sheets

TRANSFORMING SHOE WITH ROTATING, SLIDING; AND PIVOTING PANELS

BACKGROUND OF THE INVENTION

1. Technical Field

The present device is a transforming shoe that allows the user to change from one style to another by disassembling, through means of rotating side and back flap panels and sliding the rear tongue piece, and then reassembling, to user preference.

2. Background Information

During the course of a day, many people change their shoes, frequently, to accommodate their daily activities. The cost of acquiring several different shoes is not a cheap commodity. As well as, there are a growing number of people that need storage of light items such as money, and light storage compartment items, to be stored within their shoes. Many people place money into their shoes, as well as, keep and store other items for safe keep. The transforming shoe alleviates the cost of buying different shoes to accommodate the need to change shoes as a day progresses; such as, jogging for the low-top position shoe and casual wear; high-top position shoe for the ergonomics of leg support for work and casual athletics; and off the back of the foot position shoe for lounging slippers to be worn in and out of the house; thus aiding in the comfort ability of comfort to be gained into one shoe.

The transforming shoe of the present invention fulfills a need for an inexpensive, versatile, sportish shoe which can be easily transformed into a number of different shoes that one would have to acquire to accommodate during the course of a day. This shoe frees up storage space for what it would have taken to accommodate other shoes to meet one's daily requirements for shoe accommodations vs. the all in one shoe; for which, has the capabilities of several combinations all stored into one shoe. This transforming shoe has the property of consolidated storage per each individual shoe unit. In meaning, this shoe has the capabilities of production design of more than one shoe thus making it a multitude of possibility for preference of design; for which, aids in the absent need to house other shoes, to accommodate, ones' needs, thus freeing up storage space for other shoes. The transforming shoe also aids as a quick remedy for those who like to slide their feet into their shoes over the back panel of the shoe by providing rotating and sliding panels to achieve that desired function of the shoe.

With the present invention, there is no need to acquire additional shoes to accommodate ones' daily needs. Instead, the transforming shoe of the present invention can be used to accommodate these needs. Shoes according to the present invention are more versatile than other shoes, because they can be transformed to meet the constant needs of the user.

BRIEF SUMMARY OF THE INVENTION

The present invention is a multi-functional transforming shoe that can be taken apart and reassembled in a high-top shoe configuration, a low-top shoe configuration, and an open-back configuration with a strap attachment.

The attachment means are attached by connected rotating panels that are intersected by a rod axle through eyelet holes formed in the panels, allowing the panels to rotate. The panels are then attached to each respective side panel by means of complementary snap and hook-and-loop members.

The transforming shoe has rotating, sliding, and pivoting panel fixtures which add to the versatility of the present invention, enabling it to function as a multi-functional shoe with various design possibilities.

LIST OF REFERENCE NUMBERS USED IN DRAWINGS

1 right pivot side heel of shoe drawer
2 left pivot side heel of shoe drawer
3 inner inside of upper shoe bottom
4 left shoe front support panel eyelet hole
5 left side pivot drawer stopper for drawer panel reference number 2
6 right side pivot drawer stopper for drawer panel reference number 1
7 upper middle of the heel of shoe rod axle that intersects on the same rod axle through the left side (drawer panel number 2) and the right (drawer panel number 1) side of the shoe pivot drawers
8 back of snap
9 rod axle inside of shoe rectangular cut out that intersects on the same rod axle through the outside of the rectangular cut out along each side of the shoe, a loop in the bottom of the back tongue of the shoe and back through the rectangular cut out along the side of the shoe
10 folded back piece
11 sole of shoe
12 front tongue of shoe
13 loop and inner seam for passage of rod to slide through
14 right shoe axle on the upper middle right side that intersects on the axle the panels right outside pocket storage panel; right high-top trapezoid rotating side panel; front high-top support panel; and at the top right side of the shoe top notch through eyelet holes in the panels
15 left shoe axle on the upper middle left side that intersects on the axle the panels left outside pocket storage panel; left high-top trapezoid rotating side panel; front high-top support panel; and at the top left side of the shoe top notch through eyelet holes in the panels
16 right side rotating circular strip panel with snap closure on the end
17 rectangular cut out through middle of both sides of heel of shoe
18 rectangular rotating snap panel
19 inside of shoe pocket storage panel left side
20 snap member (male)
21 right side of shoe outside pocket storage panel
22 velcro
23 left side of shoe outside pocket storage panel
24 inside of shoe pocket storage panel right side
25 right shoe rotating front support panel conjoining two high top trapezoid rotating panels
26 left tab closure on outside end of pivot drawers of shoe
27 back strap of shoe
28 right tab on backside of shoe
29 left tab on back side of shoe
30 inner walls of drawer
31 outside wall of drawer
32 right shoe front support panel eyelet hole
33 snap member (female)
34 right side of back of shoe posterior rotating panel
35 left side of back of shoe posterior rotating panel
36 back tongue of shoe
37 left side rotating circular strip panel with snap closure on the end
38 eyelet hole
39 left side of high top trapezoid rotating side panel
40 right side of high top trapezoid rotating side panel

41 right side of shoe triangular high-top extension rotating panel
42 left side of shoe right triangular high-top extension rotating panel
43 right shoe axle on the upper middle left side that intersects on the axle the panels left outside pocket storage panel; left high-top trapezoid rotating side panel; and at the top left side of the shoe top notch through eyelet holes in the panels
44 left shoe axle on the upper middle right side that intersects on the axle the panels right outside pocket storage panel; right high-top trapezoid rotating side panel; and at the top right side of the shoe top notch through eyelet holes in the panels
45 right tab closure on outside end of pivot drawers
46 left shoe rotating front support panel conjoining two high top trapezoid rotating panels
47 left side of shoe rod axle on the upper back of the shoe that intersects on the same rod axle the panels of the outer back tab of shoe on backside of shoe, inner pocket storage panel, posterior rotating panel; for which, the end piece of the rod are a female snap member on one end of the rod that is inside of the shoe, and a square knob that is on the outside of the rod axle
48 right side of shoe rod axle on the upper back of the shoe that intersects on the same rod axle the panels of the outer back tab on backside of shoe, inner pocket storage panel, posterior rotating panel; for which, the end piece of the rod are a female snap member on one end of the rod that is inside of the shoe, and a square knob that is on the outside of the rod axle
49 left side of shoe rod axle inside of the high-top trapezoid rotating side panel intersects the bottom angle of the right triangle high-top extension and the inner back of the high-top trapezoid rotating side panel
50 right side of shoe rod axle inside of the high-top trapezoid rotating side panel intersects the bottom angle of the right triangle high-top extension and the inner back of the high-top trapezoid rotating side panel
51 left side of the shoe rod axle on the inside of the shoe that intersects the the rotating circular panel, and the inside of shoe pocket storage panel
52 right side of the shoe rod axle on the inside of the shoe that intersects the rotating circular panel, and the inside of shoe pocket storage panel
53 left side of shoe rod axle adjacent to the rectangular cutout in the middle of the heel of shoe that intersects the rotating rectangular snap panel and the back heel of shoe on the same rod axle
54 right side of shoe rod axle adjacent to the rectangular cutout in the middle of the heel of shoe that intersects the rotating rectangular snap panel and the back heel of shoe on the same rod axle
55 left side of the shoe right triangle high-top extension eyelet hole
56 right side of the shoe right triangle high-top extension eyelet hole
57 left side of shoe outside pocket storage panel eyelet hole
58 right side of shoe outside pocket storage panel eyelet hole
59 left side of shoe rotating circular panel eyelet hole
60 right side of shoe rotating circular panel eyelet hole
61 left side of shoe rectangular rotating snap panel eyelet hole
62 right side of shoe rectangular rotating snap panel eyelet hole
63 left side of shoe inside shoe pocket storage panel eyelet hole
64 right side of shoe inside pocket storage panel eyelet hole
65 left side of shoe high-top trapezoid rotating side panel eyelet hole
66 right side of shoe high-top trapezoid rotating side panel eyelet hole
67 left side of shoe posterior rotating panel eyelet hole
68 right side of shoe posterior rotating panel eyelet hole

BRIEF DESCRIPTION OF THE SEVERAL VIEWS OF THE DRAWINGS

An intensive understanding of the invention and the great importance of its' uses; can be concluded with understanding from the following detailed description of the drawings, wherein, examples of the invention are described, and wherein.

DETAILED DESCRIPTION OF THE INVENTION

Figure 1:
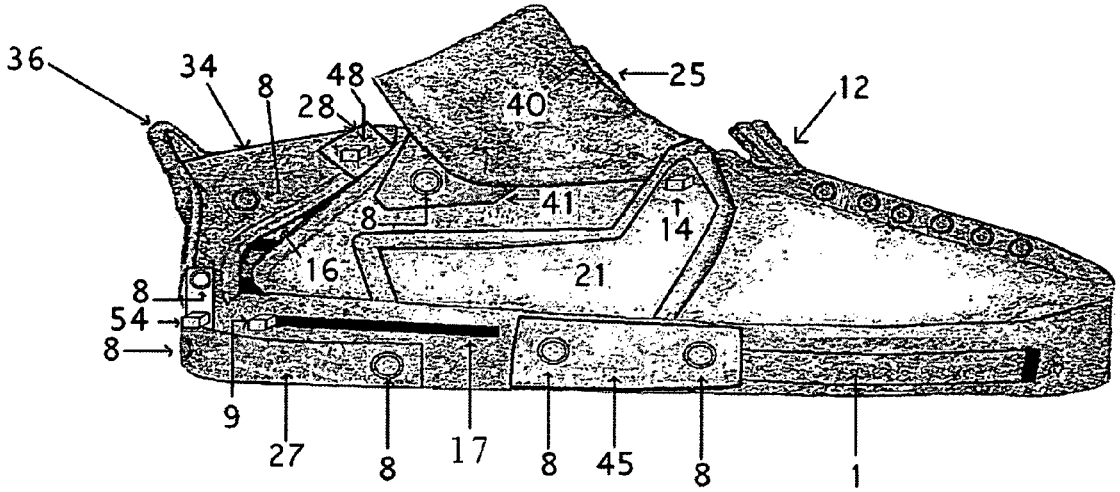
FIG. 1 is the right perspective view of the high-top position with heel of shoe pivot drawer in the (storage in) position and posterior rotating panel and back tongue of shoe in extended position on a right shoe
Figure 2:
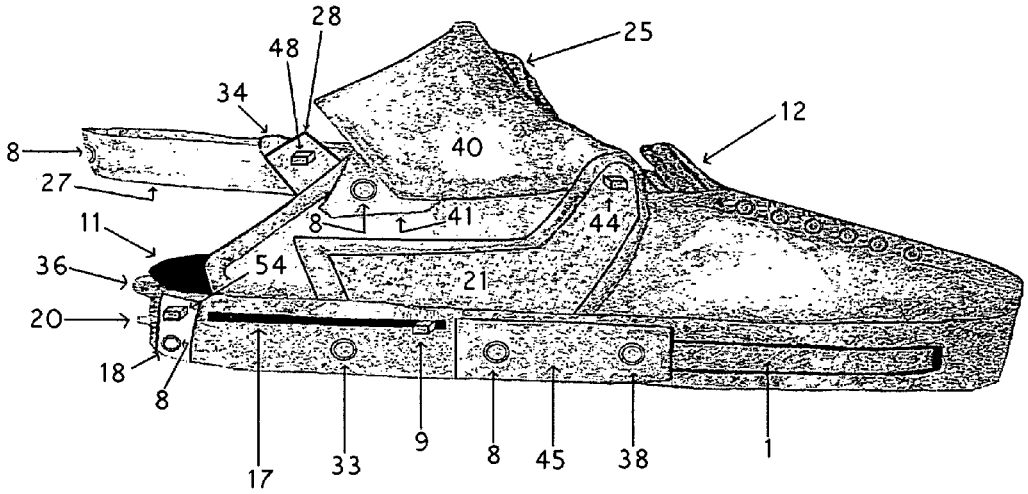
FIG. 2 is a right perspective view of a right shoe in high-top position with heel of shoe pivot drawer in the (storage in) position and posterior rotating panel and back tongue of shoe (in storage position) with back scrap attached to the posterior rotating panel on a right shoe
Figure 3:
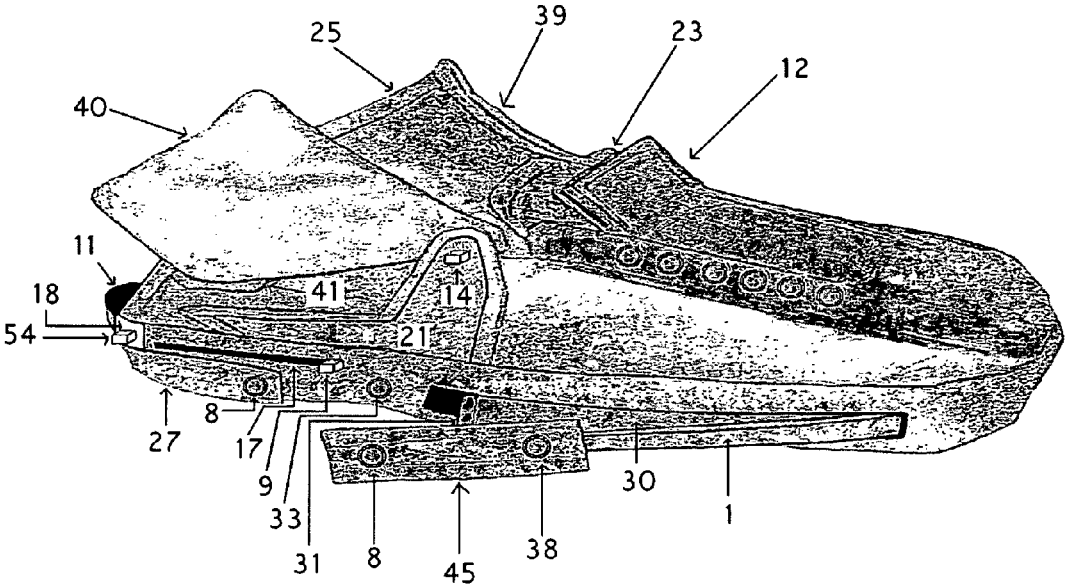
FIG. 3 is the right perspective view of the high-top position with heel of shoe pivot drawer in the out extended position and posterior rotating panel and back tongue of shoe in storage position on a right shoe
Figure 4:
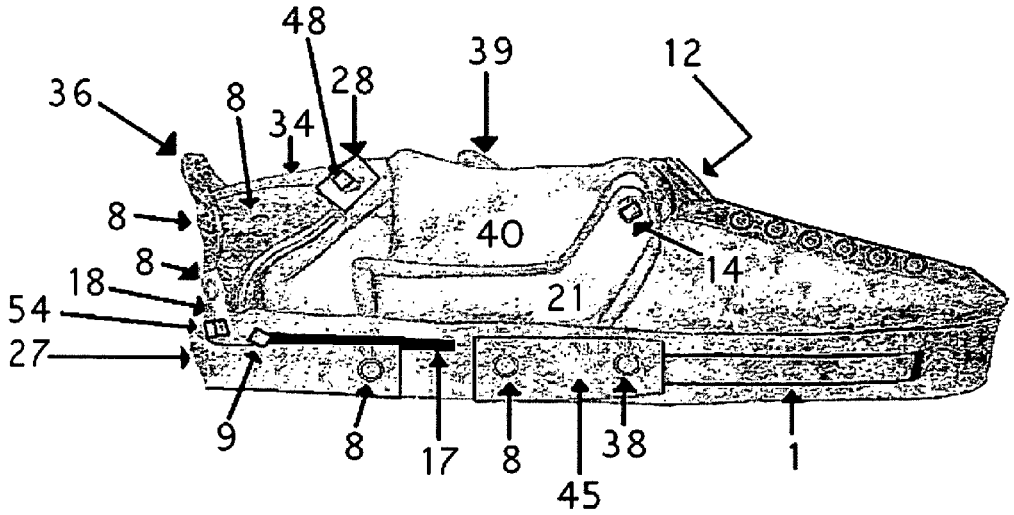
FIG. 4 is a right perspective view of a right shoe, in low-top position with side heel of shoe pivot drawer in the (storage in) position and posterior rotating panel and back tongue of shoe in the extended position
Figure 5:
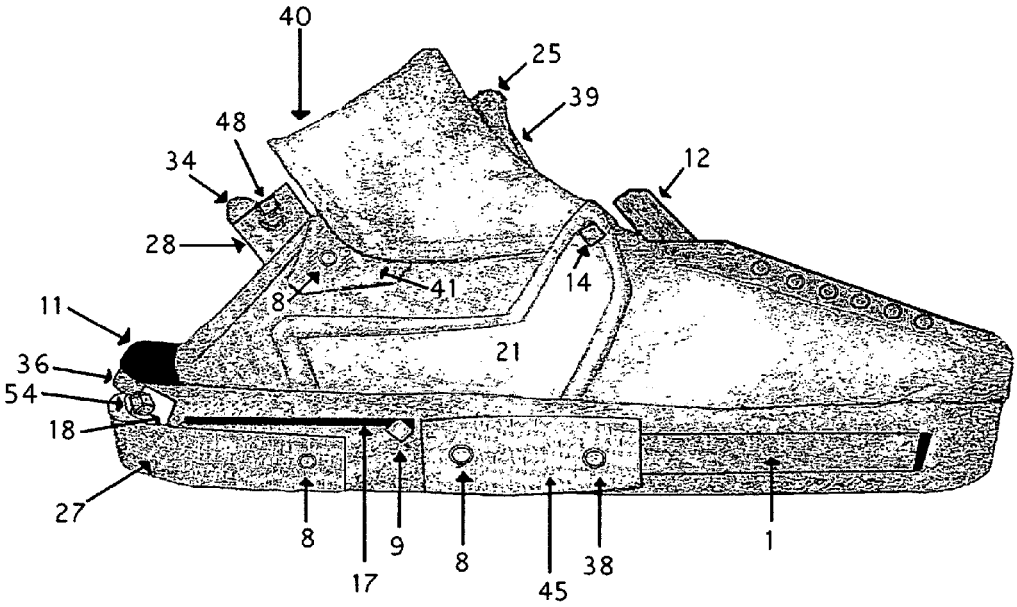
FIG. 5 is the right perspective view of the high-top with heel of shoe pivot drawer in the (storage in) position and posterior rotating panel and back tongue of shoe (in storage position) on a right shoe
Figure 6:
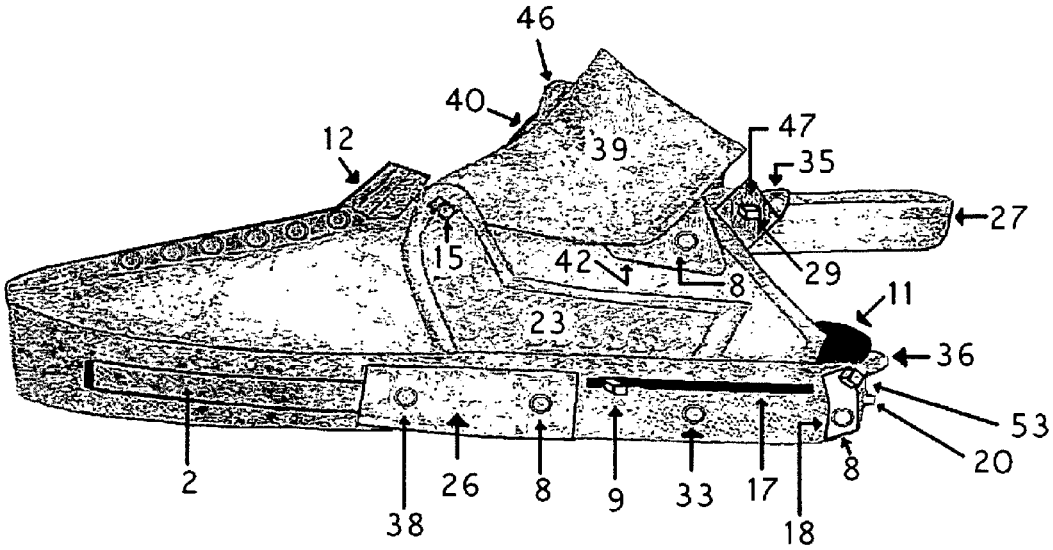
FIG. 6 is a left perspective view of the shoe in high-top position with heel of shoe pivot drawer in the (storage in) position and the posterior rotating panel and back tongue of shoe in the storage position with back scrap attached to the posterior rotating panel on a left shoe
Figure 7:
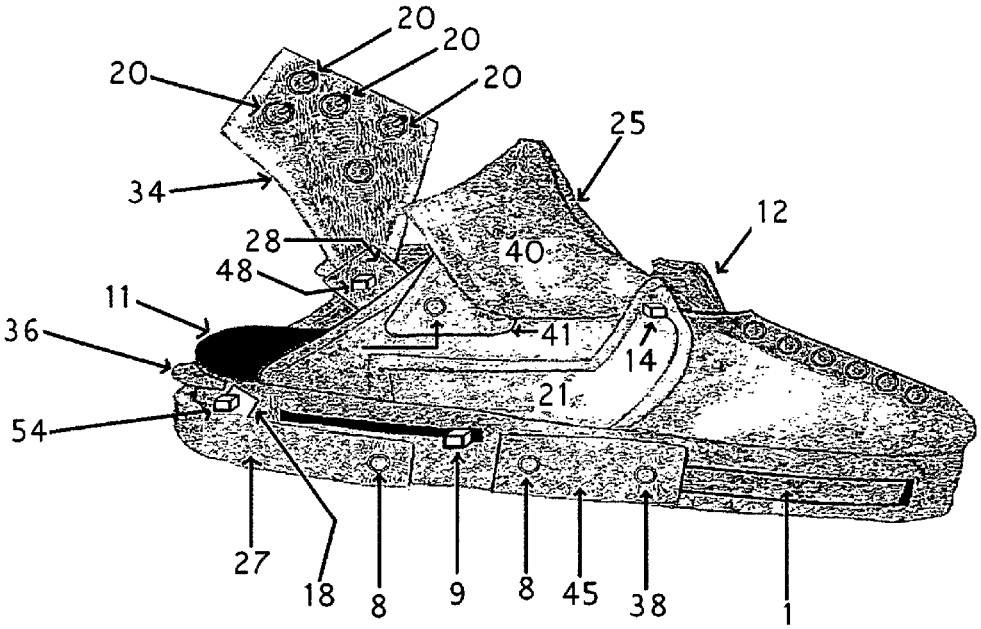
FIG. 7 is a right perspective view of a right shoe, in high-top position with side heel of shoe pivot drawer in the (storage in) position and posterior rotating panel in wing up position and back tongue of shoe in the storage in position
Figure 8:
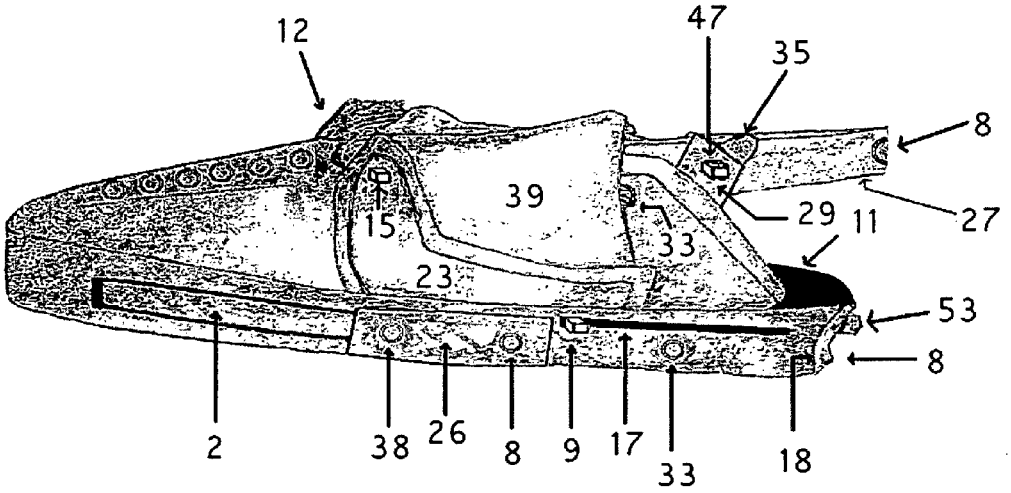
FIG. 8 is the left perspective view of the low-top position with heel of shoe pivot drawer in the (storage in) position and the posterior rotating panel and back tongue of shoe in storage position with scrap attached to the posterior rotating panel on a left shoe
Figure 9:
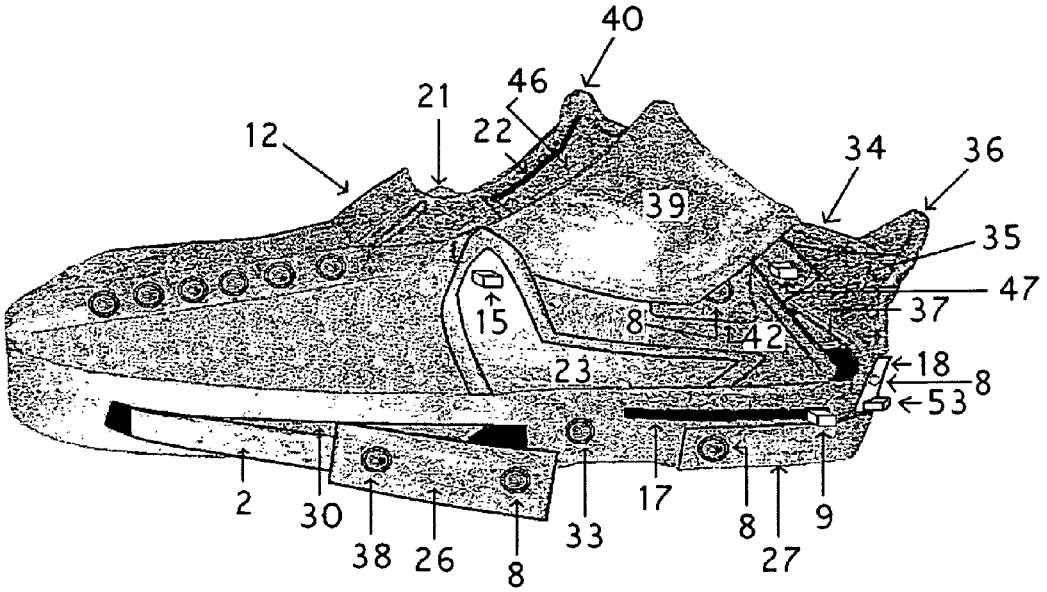
FIG. 9 is a left perspective view of a left shoe, in high-top position with side heel of shoe pivot drawer in the out position and posterior rotating back panel and back tongue of shoe in the extended position
Figure 10:
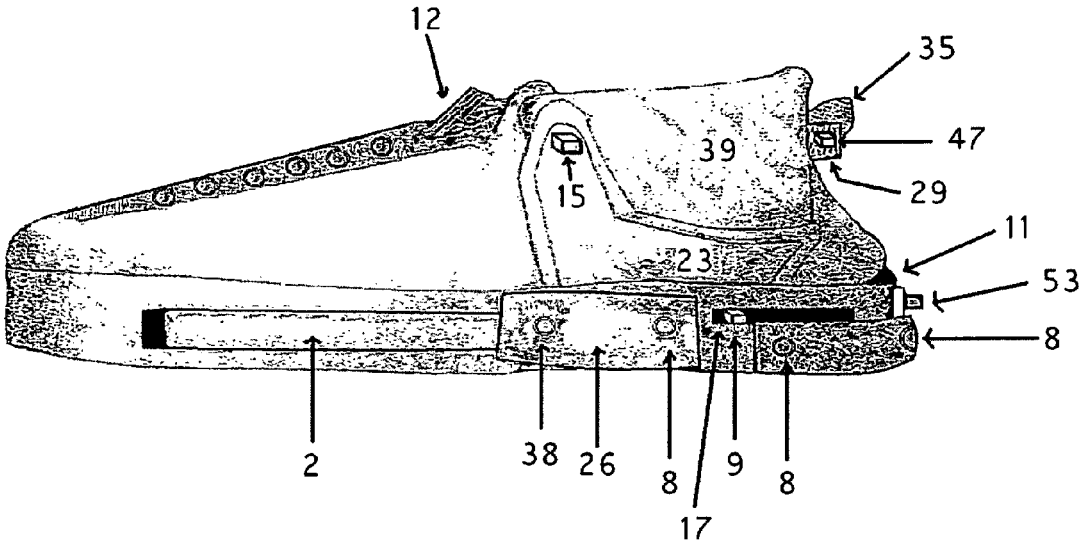
FIG. 10 is the left perspective view of the low-top position with heel of shoe pivot drawer in the (storage in) position and back tongue of shoe and posterior rotating panel in storage position on a left shoe
Figure 11:
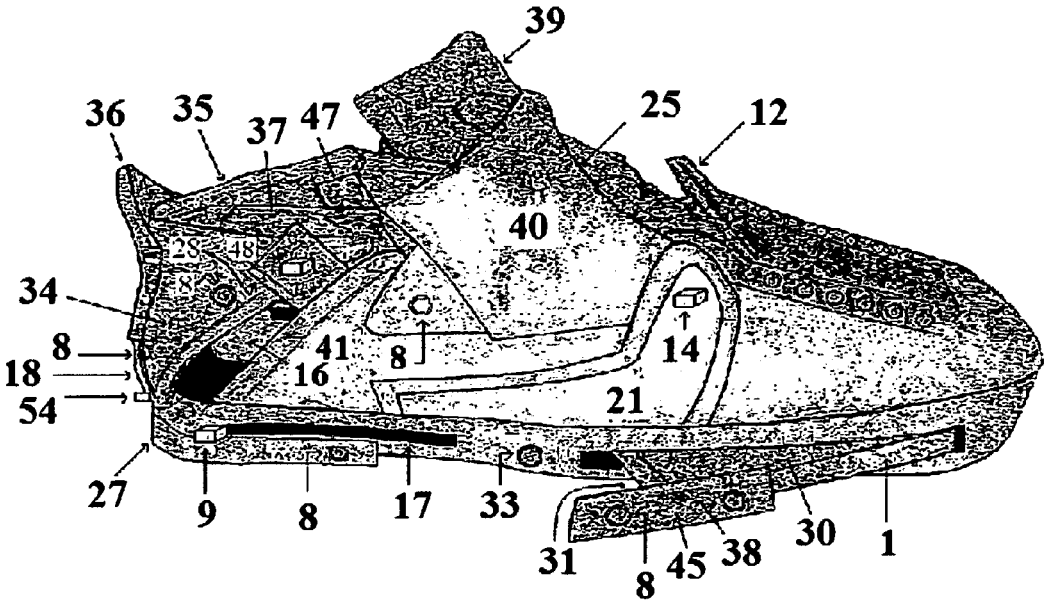
FIG. 11 is the right perspective view of the high-top position with heel of shoe pivot drawer in the out extended position and posterior rotating panel and back tongue of shoe in extended position on a right shoe
Figure 12:
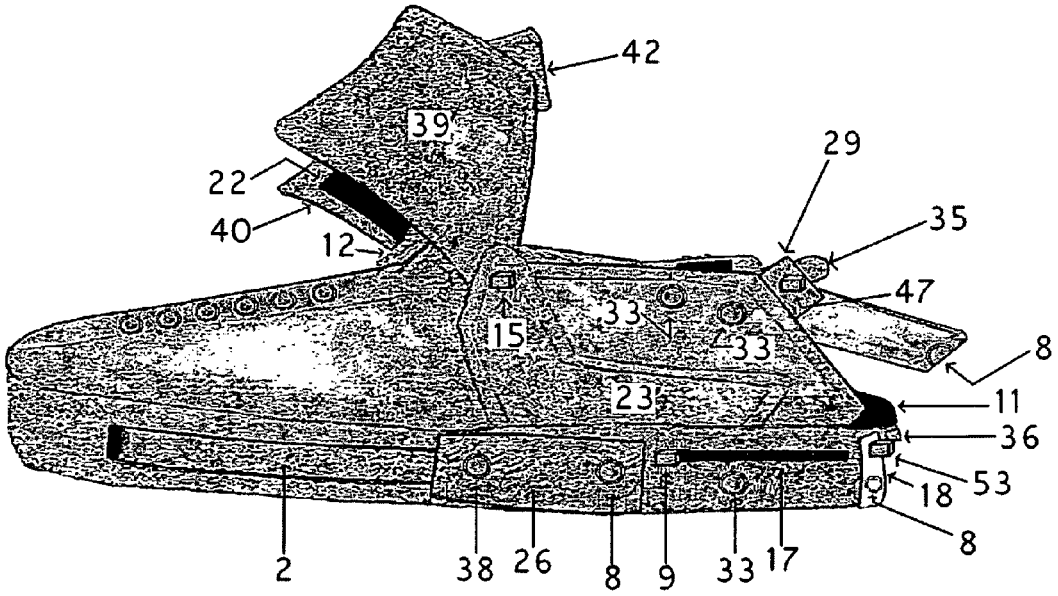
FIG. 12 is the left perspective view of a left shoe with high-top trapezoid rotating side panels in winged up position with posterior rotating panels in storage position and back tongue of shoe in storage position with scrap attached to the posterior rotating panel
Figure 13:
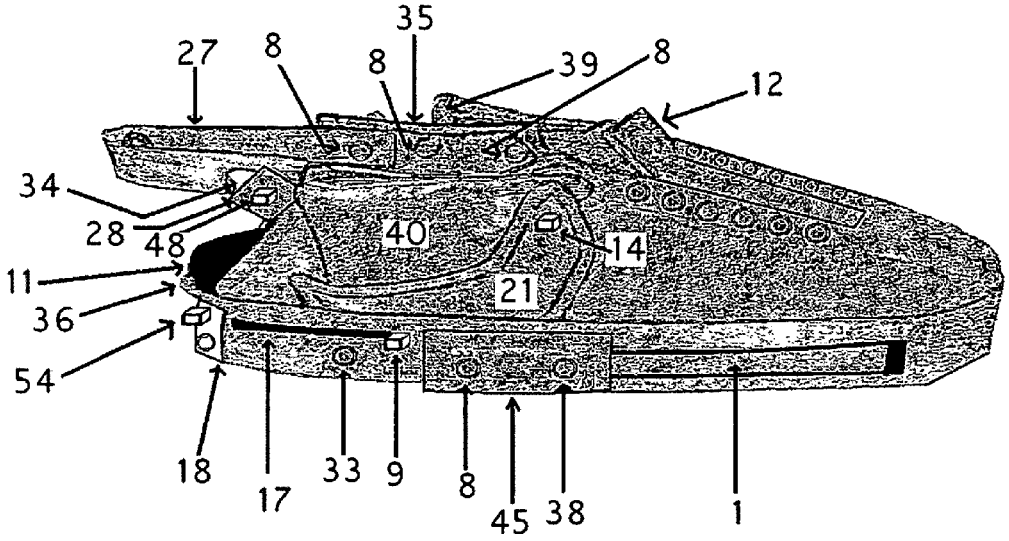
FIG. 13 is the right perspective view of the low-top position with heel of shoe pivot drawer in the (storage in) position and the back posterior rotating panel and back tongue of shoe in storage position with scrap attached to the posterior back rotating panel on a right shoe
Figure 14:
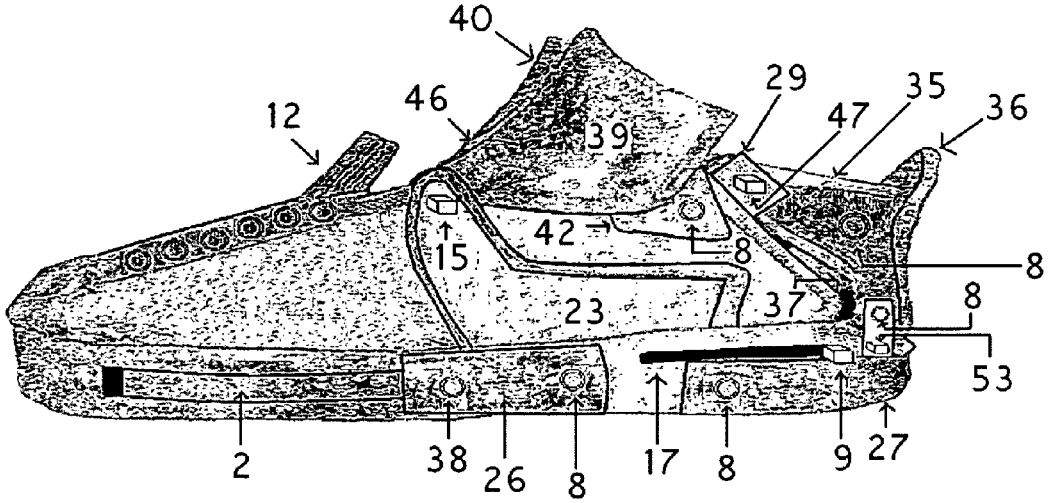
FIG. 14 is a left perspective view of a left shoe, in high-top position with side heel of shoe pivot drawer in the (storage in) position and posterior rotating panel and back tongue of shoe in the extended position
Figure 15:
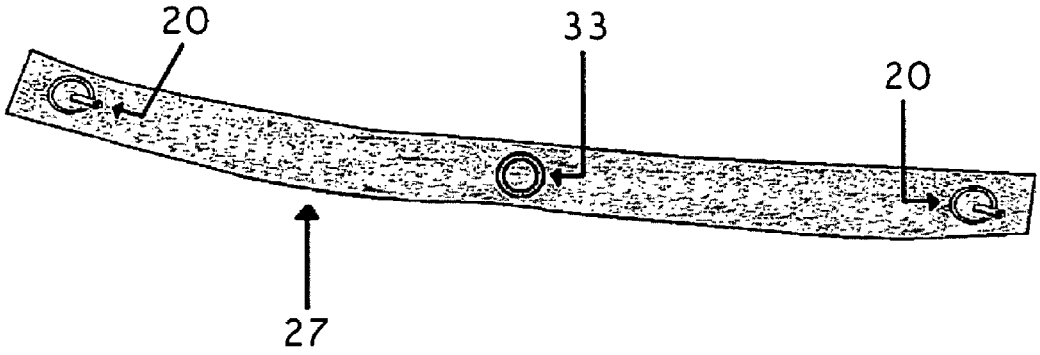
FIG. 15 is a view of the back scrap of the shoe that attaches by complimentary snap attachments to the heel of the shoe for storage and the posterior rotating panel for scrap support of the shoe
Figure 16:
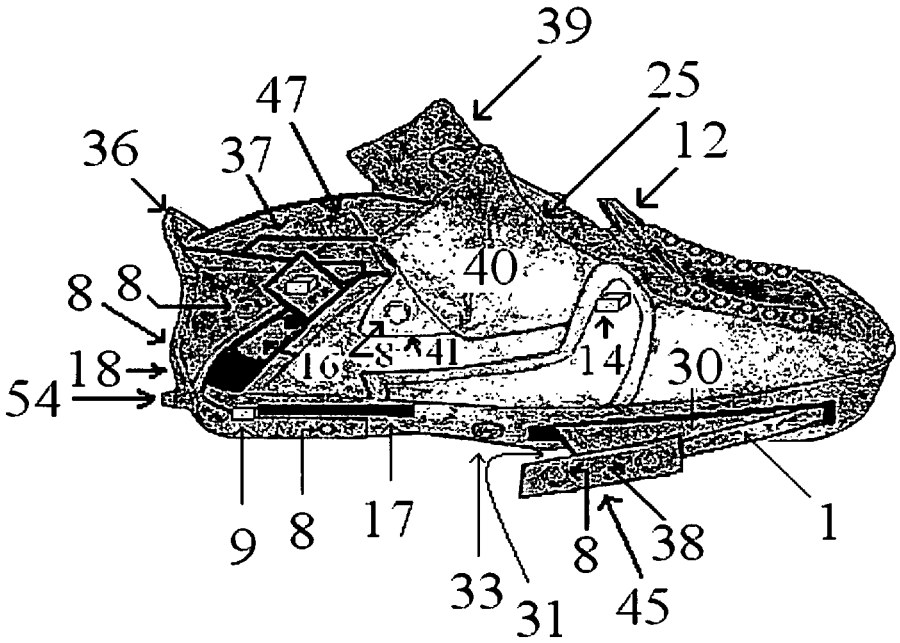
FIG. 16 is a right perspective view of a right shoe, in high-top position with side heel of shoe pivot drawer in the out position and posterior rotating panel and back tongue of shoe in the extended position
Figure 17:
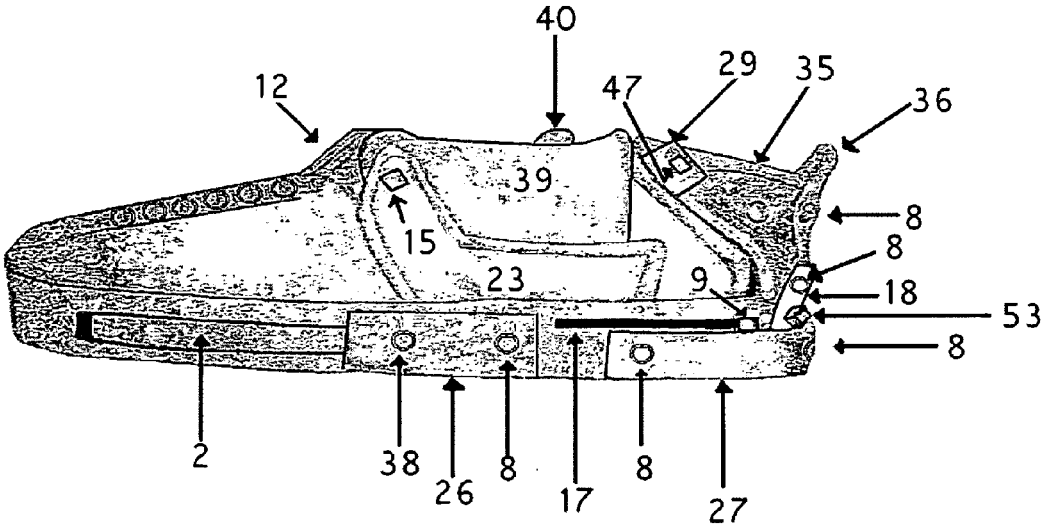
FIG. 17 is a left perspective view of a left shoe in low top position with side heel of shoe pivot drawer in the (storage in) position and posterior rotating panel and back tongue of shoe in the extended position
Figure 18:
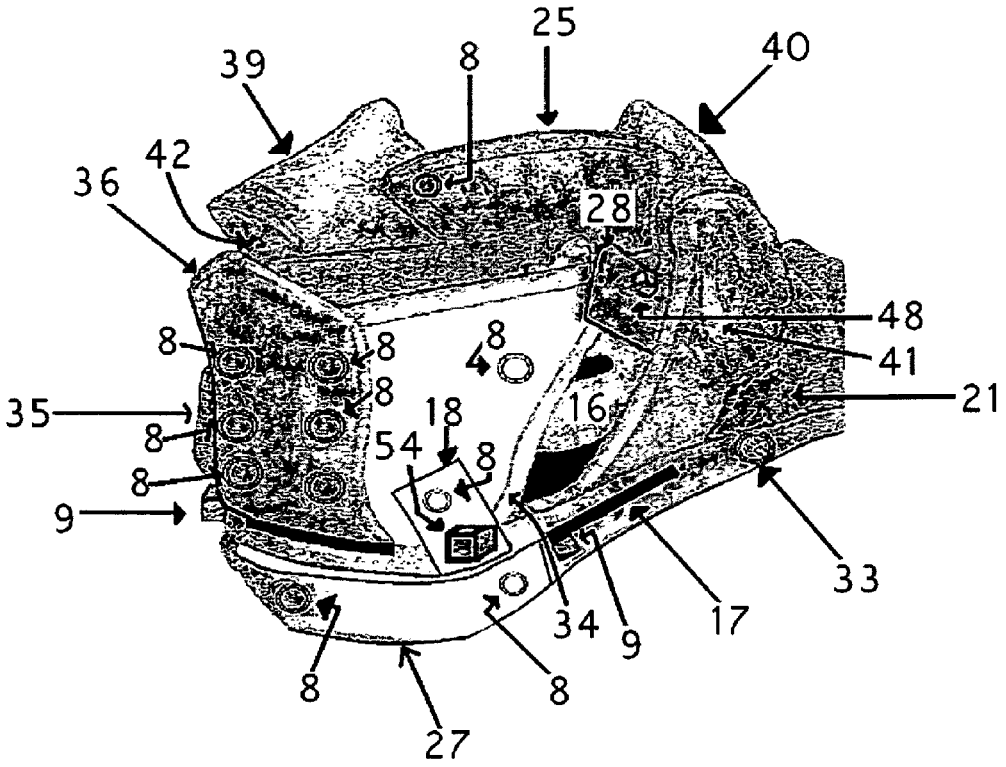
FIG. 18 is an cross sectional angled view of the back of the shoe
Figure 19:
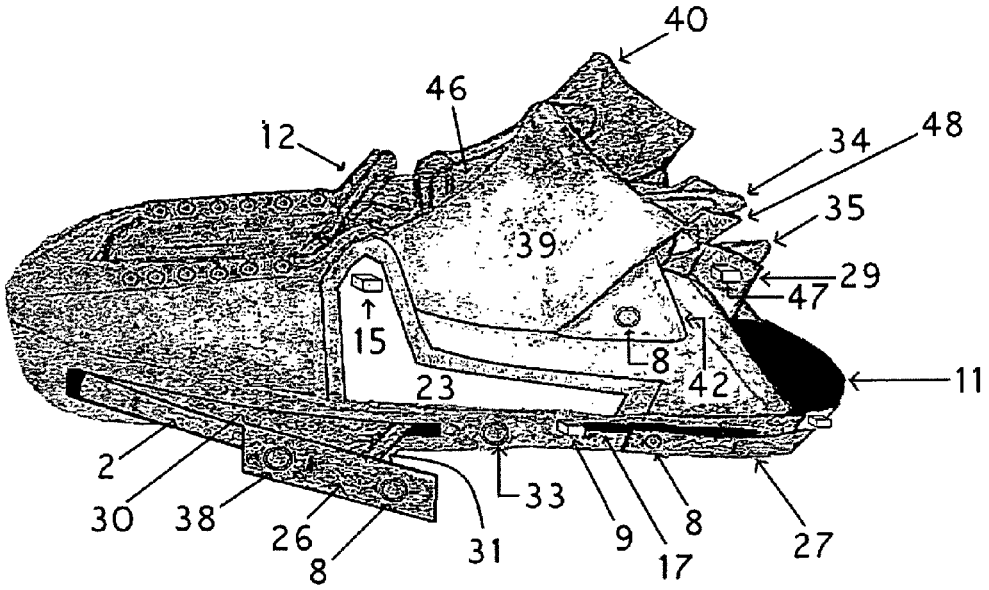
FIG. 19 is a left perspective view of shoe in high-top position with heel of shoe pivot drawer in the (out extended) position and the posterior rotating panel and back tongue of shoe in storage position on a left shoe
Figure 20:
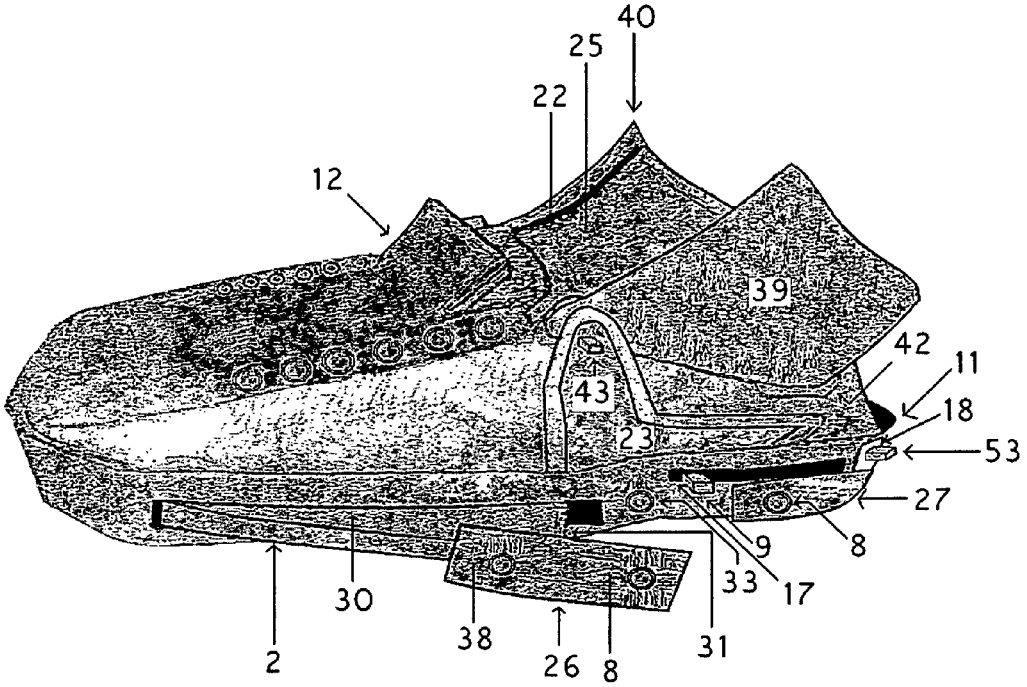
FIG. 20 is a left perspective view of a right shoe, in high-top position with side heel of shoe pivot drawer in the out position and posterior rotating panel and back tongue of shoe in the (storage in) position
Figure 21:
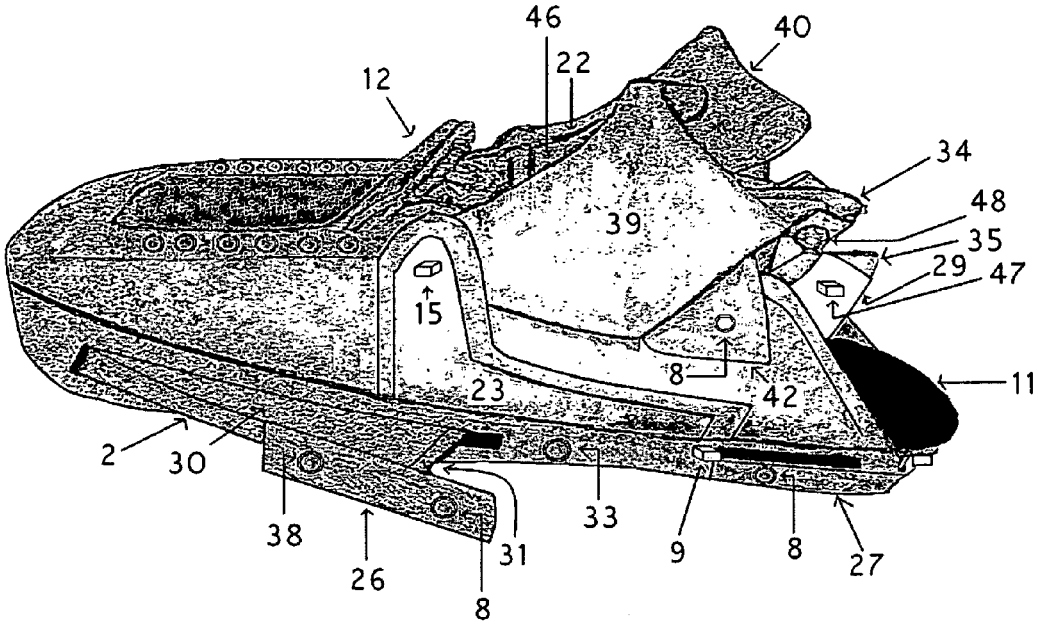
FIG. 21 is a left perspective view of shoe, in high-top position with side heel of shoe pivot drawer in the out position and posterior rotating panel and back tongue of shoe in the (storage in) position
Figure 22:
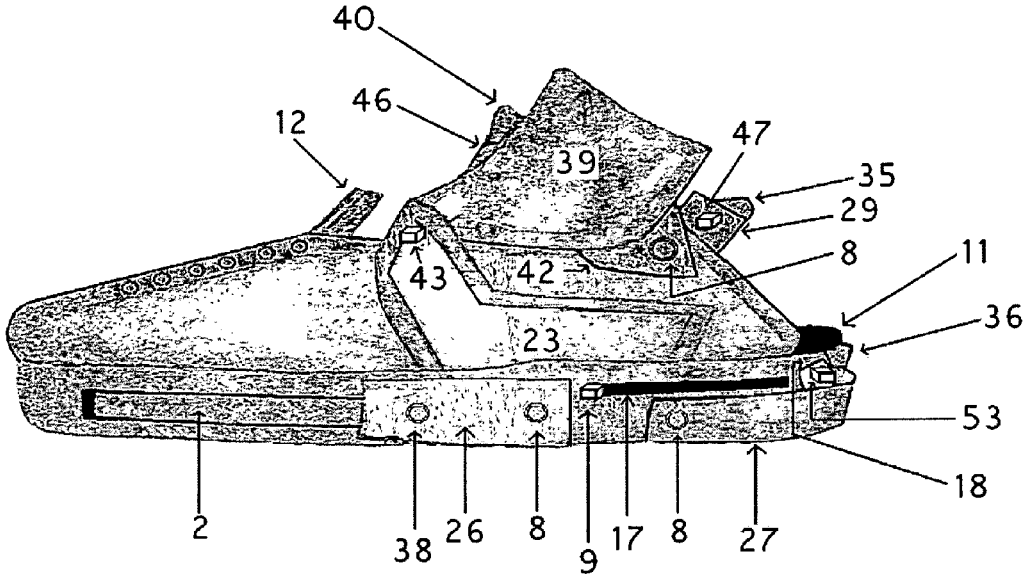
FIG. 22 is a left perspective view of shoe, in high-top position with side heel of shoe pivot drawer in the (storage in) position and posterior rotating panel and back tongue of shoe in the (storage in) position
Figure 23:
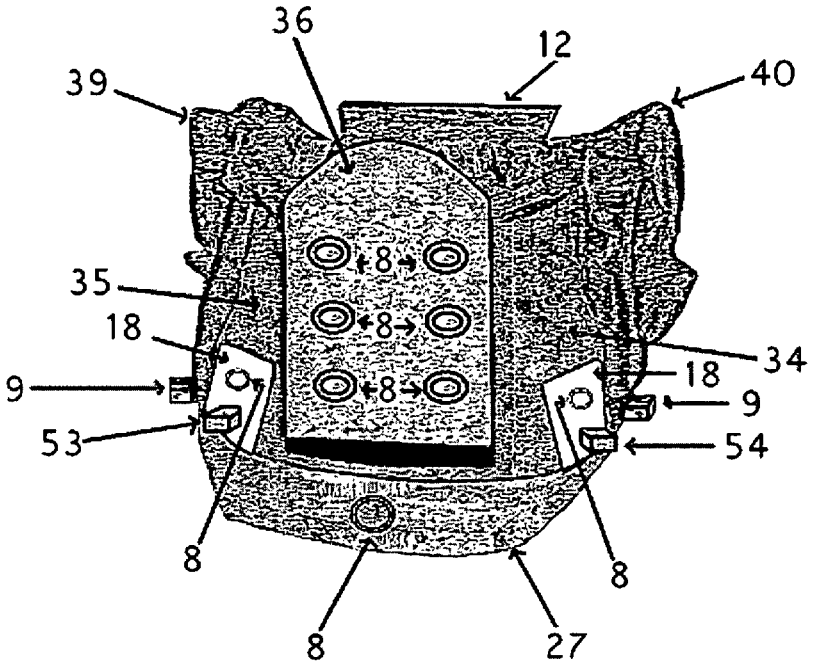
FIG. 23 is a rear elevational view of back shoe panels assembled to complimentary connecting panels and support piece in the up position
Figure 24:
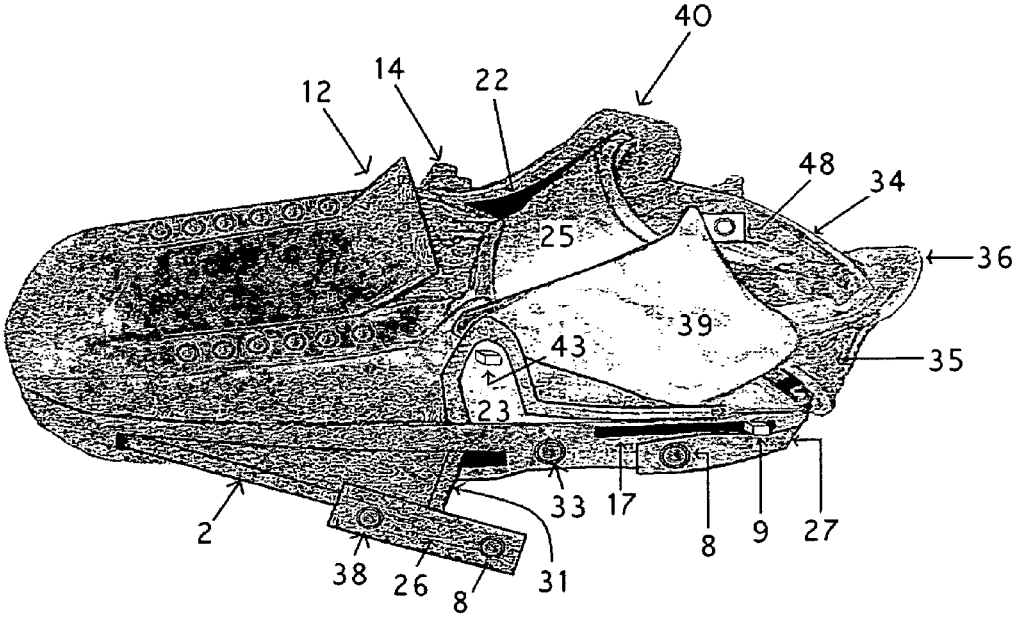
FIG. 24 is a top left perspective view of a right shoe, in high-top position with side heel of shoe pivot drawer in the out position and posterior rotating panel and back tongue of shoe in the extended position
Figure 25:
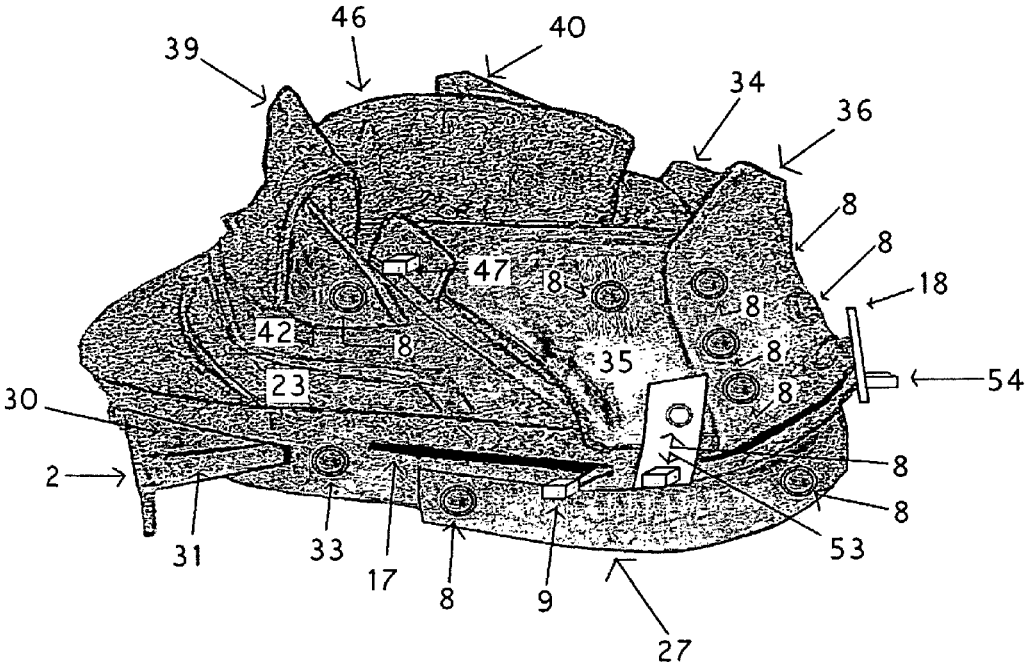
FIG. 25 is a left perspective view of shoe, in high-top position with side heel of shoe pivot drawer in the out position and posterior rotating panel and back tongue of shoe in the extended position
Figure 26:
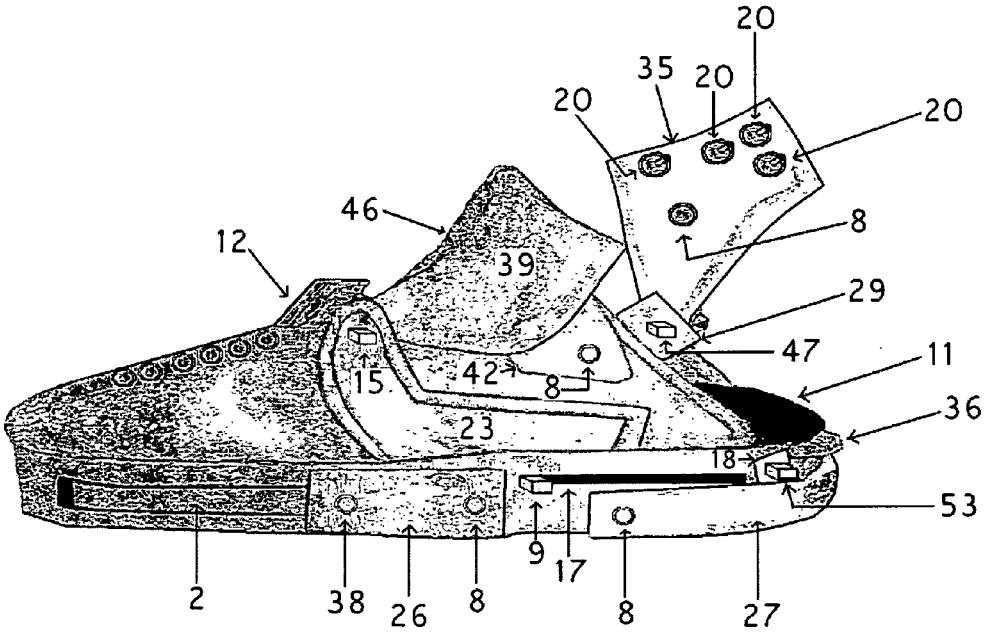
FIG. 26 is a left perspective view of shoe, in high-top position with side heel of shoe pivot drawer in the (storage in) position and posterior rotating panel in wing up position and back of tongue in the (storage in) position
Figure 27:
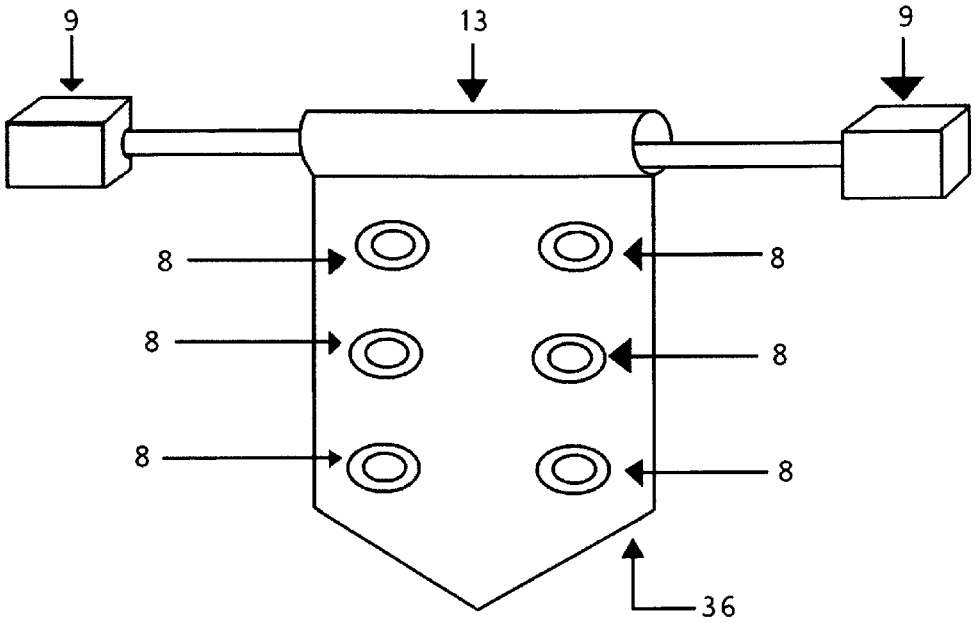
FIG. 27 is a back perspective illustrational view of the back tongue of shoe part of shoe showing the bottom of the back tongue of the shoe in a looped which allows the axle to intersect through the loop of the back tongue of the shoe
Figure 28:
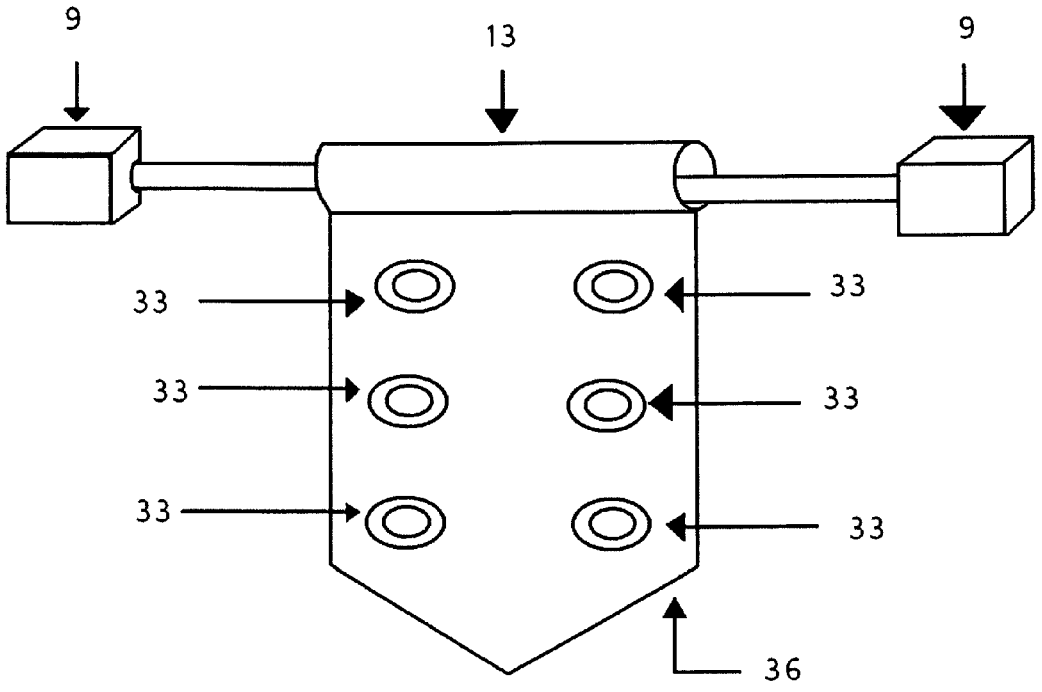
FIG. 28 is a front perspective illustrational view of the back tongue of shoe part of shoe showing the part looped connect with an axle intersecting through the loop of the back tongue of the shoe the bottom of the back tongue of the shoe in a looped which allows the axle to intersect through the loop of the back tongue of the shoe and the female snap components that complimentarily connect to each respective snap along the side the posterior rotating panels.
Figure 29:
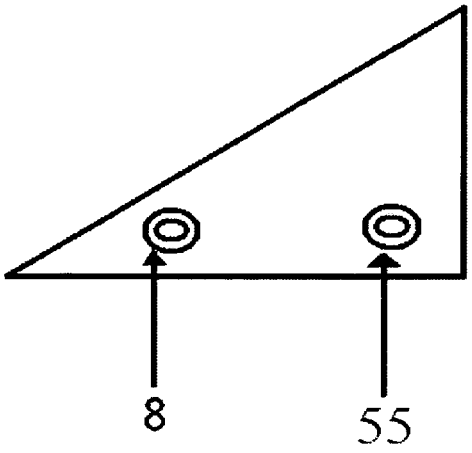
FIG. 29 is an illustrational view of the right triangle high-top extension rotating panel
Figure 30:
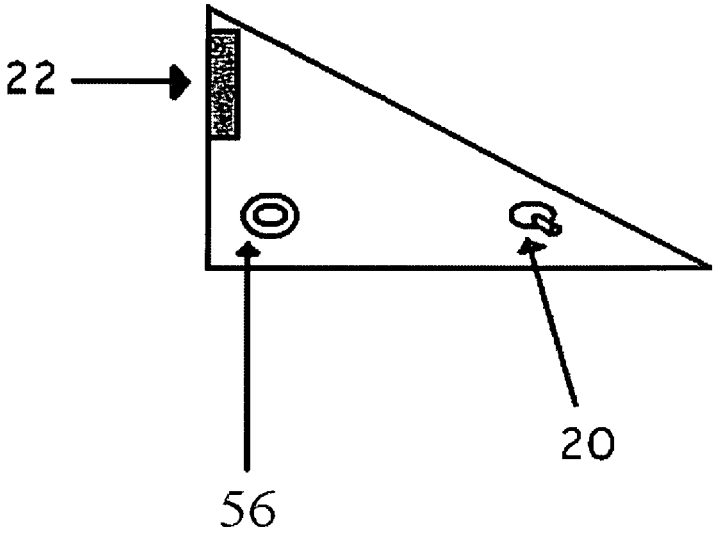
FIG. 30 is an illustrational view of the right triangle high-top extension rotating panel
Figure 31:
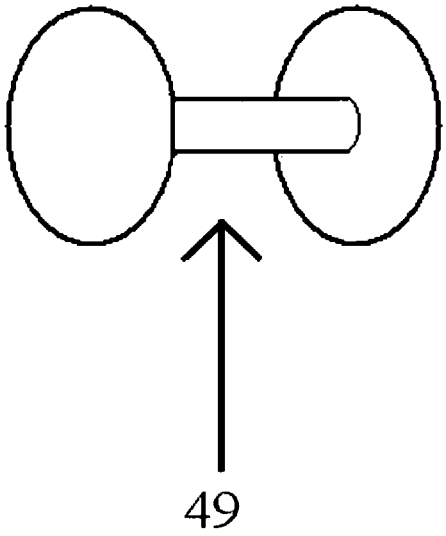
FIG. 31 is an illustrational view of the rod axle that inserts through eyelid hole of the right triangle high-top extension rotating panel of the left side of the shoe
Figure 32:
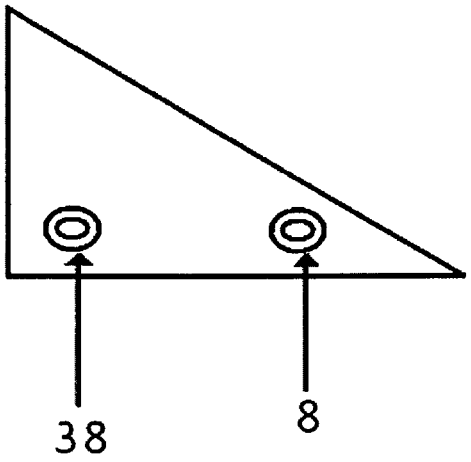
FIG. 32 is an illustrational view of the right triangle high-top extension rotating panel
Figure 33:
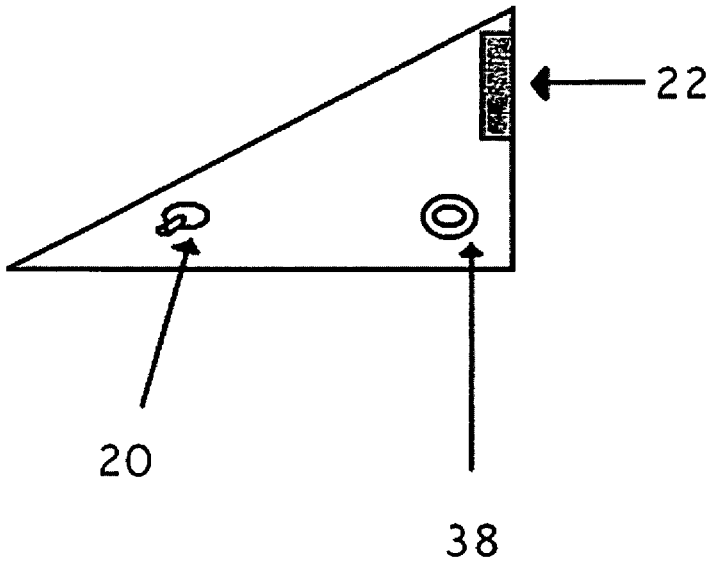
FIG. 33 is an illustrational view of the right triangle high-top extension rotating panel
Figure 34:
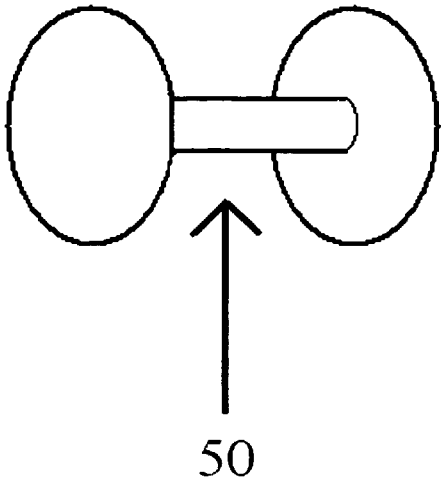
FIG. 34 is an illustrational view of the rod axle that inserts through eyelid hole of the right triangle high-top extension rotating panel of the right side of the shoe
Figure 35:
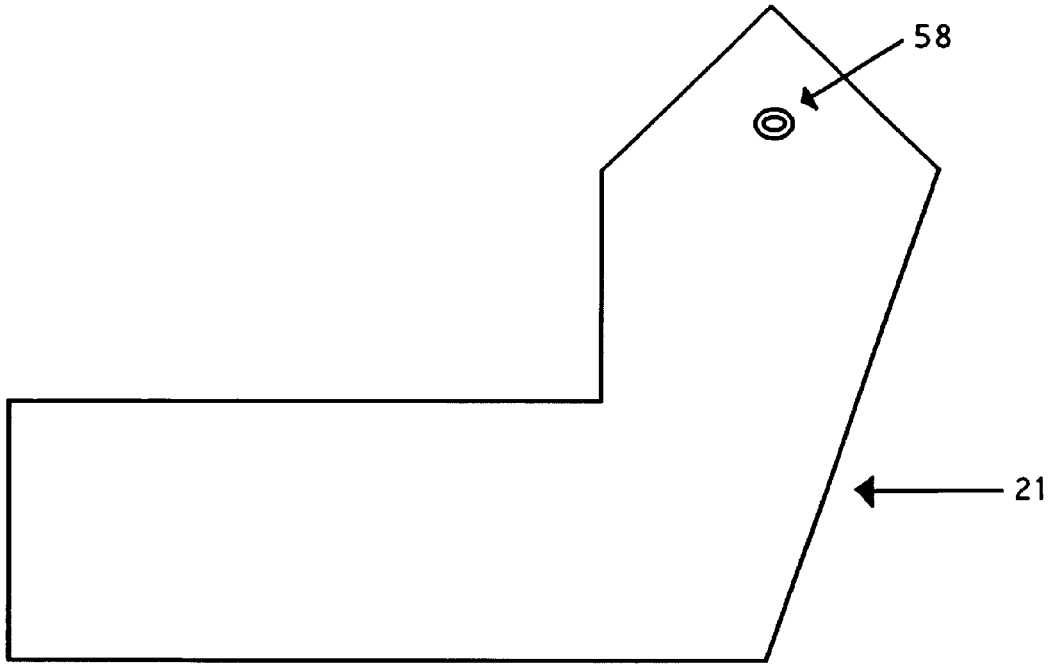
FIG. 35 is a right side of shoe perspective illustrational view of the shoe pocket storage panel
Figure 36:
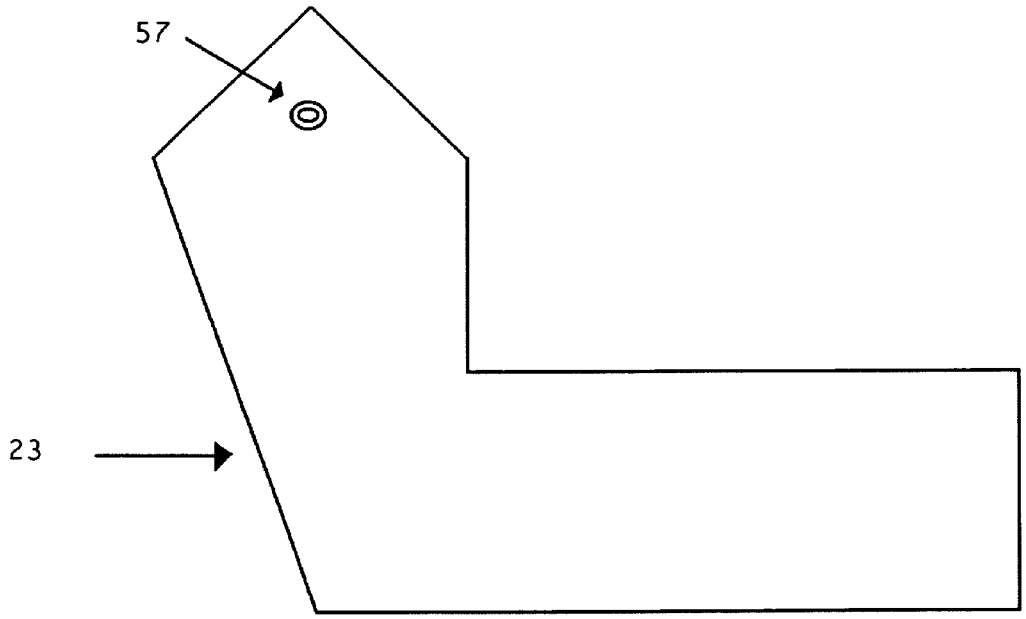
FIG. 36 is a left side of shoe perspective illustrational view of the shoe pocket storage panel
Figure 37:
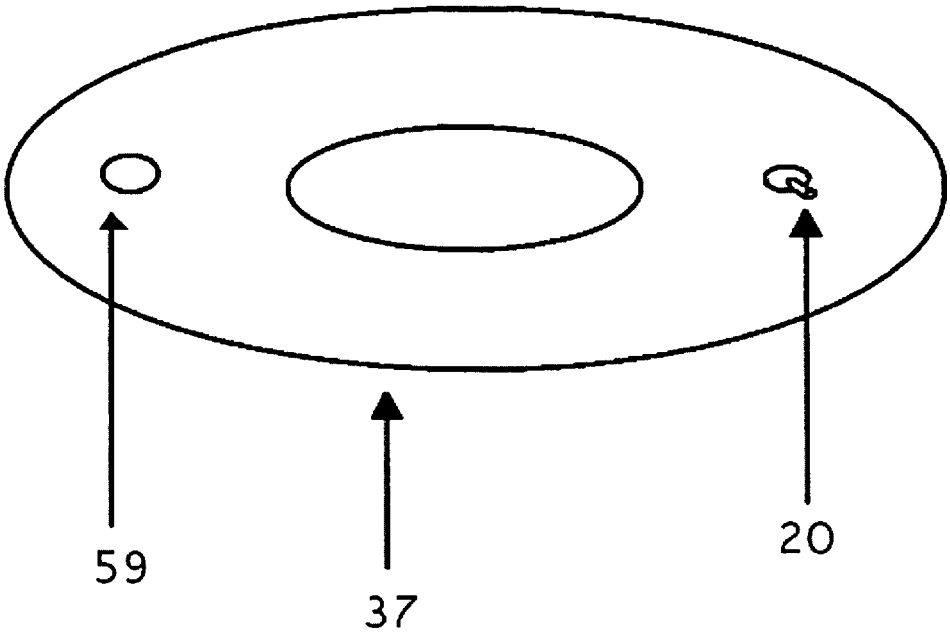
FIG. 37 is an illustrational view of the back of the left side rotating circular strip panel
Figure 38:
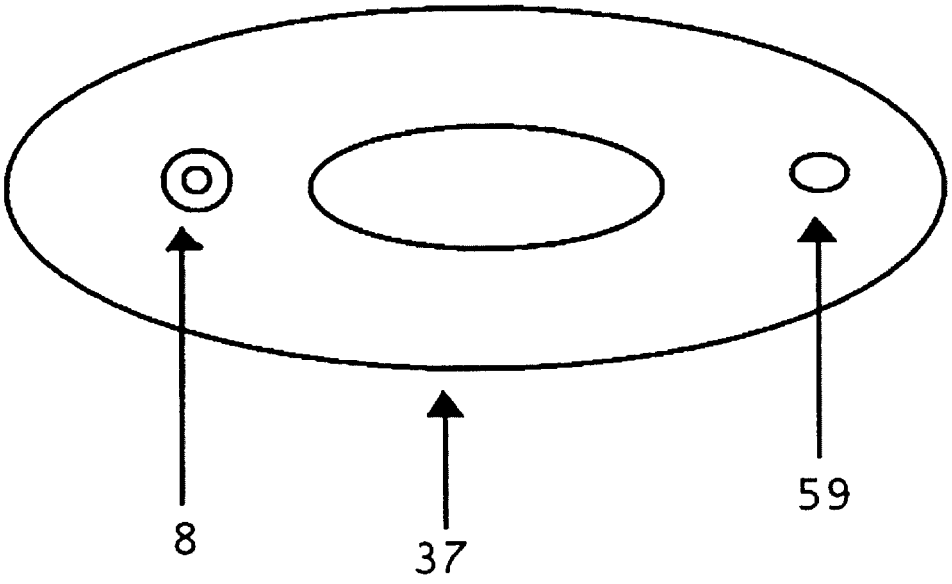
FIG. 38 is an illustrational view of the front left side rotating circular strip panel
Figure 39:
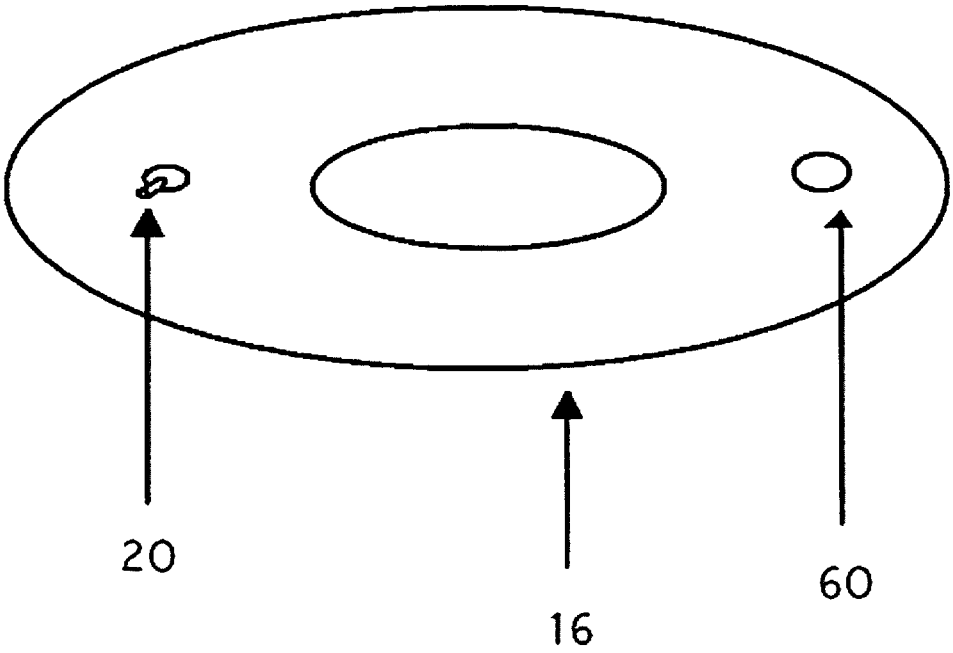
FIG. 39 is an illustrational view of the back of the right side rotating circular strip panel
Figure 40:
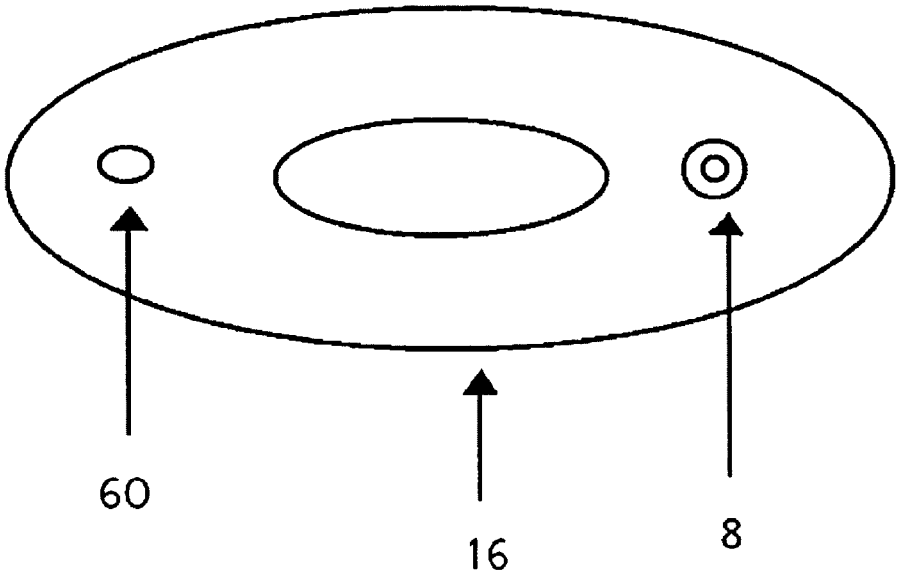
FIG. 40 is an illustrational view of the front side of right side rotating circular strip panel
Figure 41:
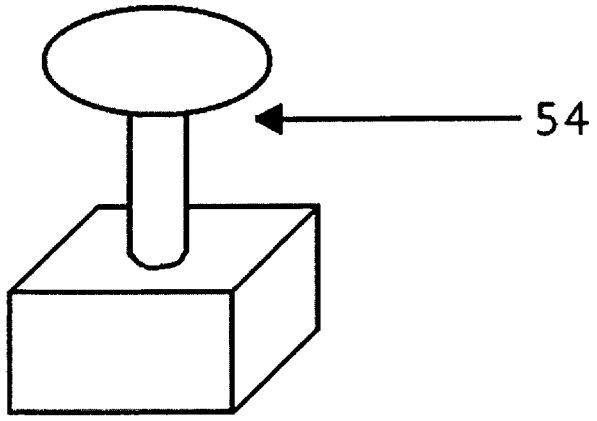
FIG. 41 is an illustrational view of the rod and end pieces axle that intersects through the rectangular rotating snap panel support bracket of the back of shoe and the heel of the shoe on the right side
Figure 42:
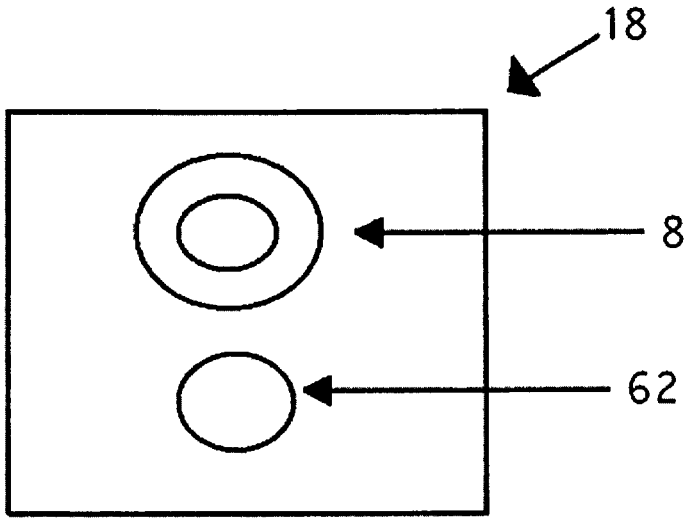
FIG. 42 is an illustrational view of the back of the rectangular rotating snap panel support bracket on back of the shoe for the right side of the shoe
Figure 43:
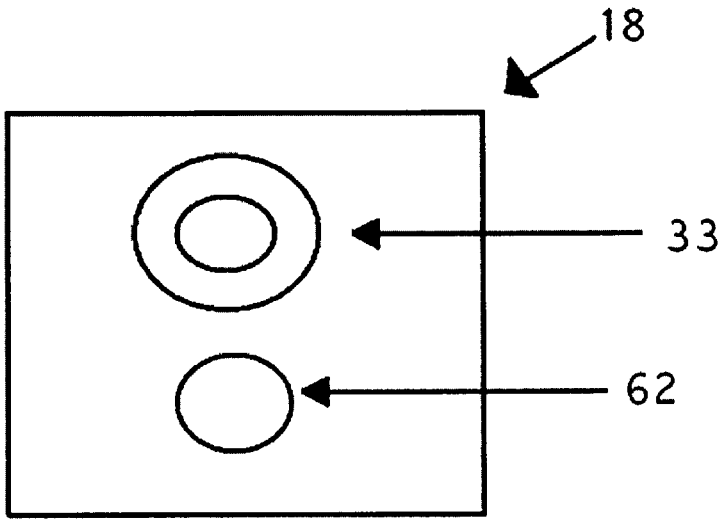
FIG. 43 is an illustrational view of the front of the rectangular rotating snap panel support bracket on the back of the shoe for the right side of the shoe
Figure 44:
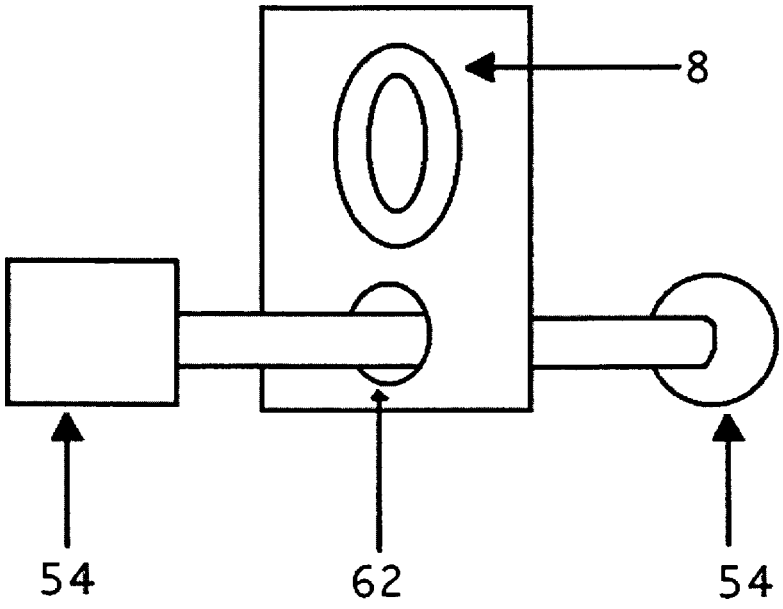
FIG. 44 is an illustrational view of the back of the rectangular rotating snap panel support bracket on the back of the shoe showing the intersection of the axle for the right side of the shoe
Figure 45:
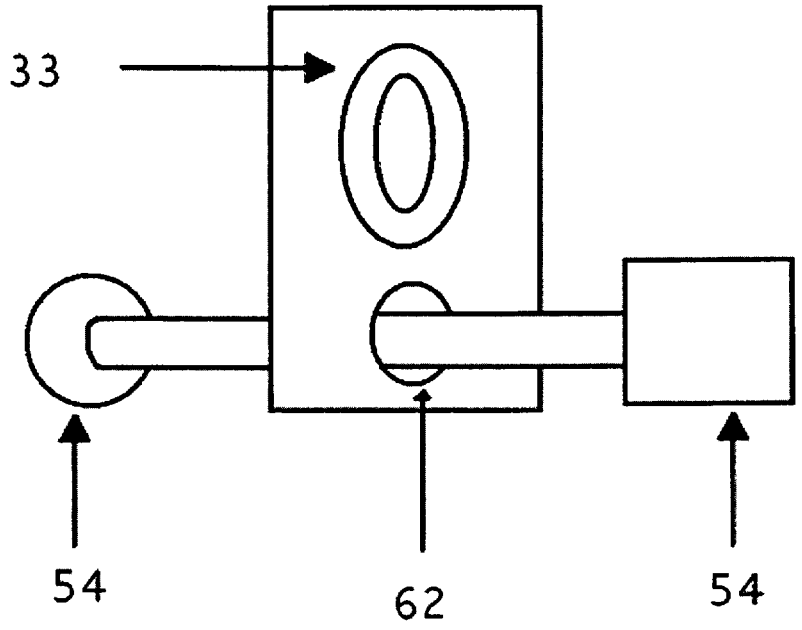
FIG. 45 is an illustrational view of the back of the rectangular rotating snap panel support bracket on the back of the shoe showing the intersection of the axle for the right side of the shoe
Figure 46:
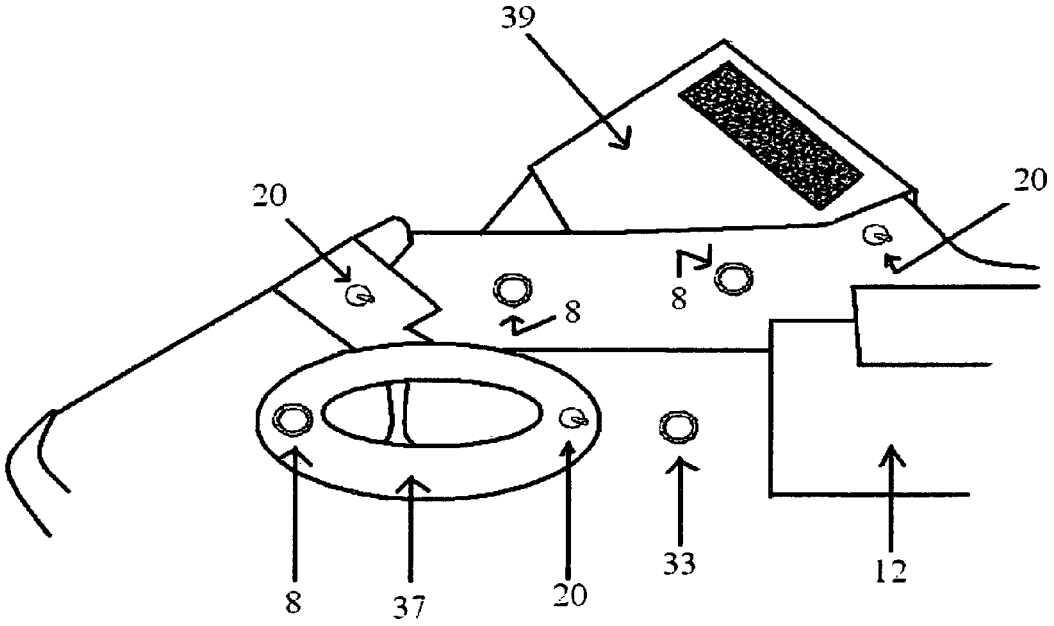
FIG. 46 is the illustrational view of the inside of shoe panels
Figure 47:
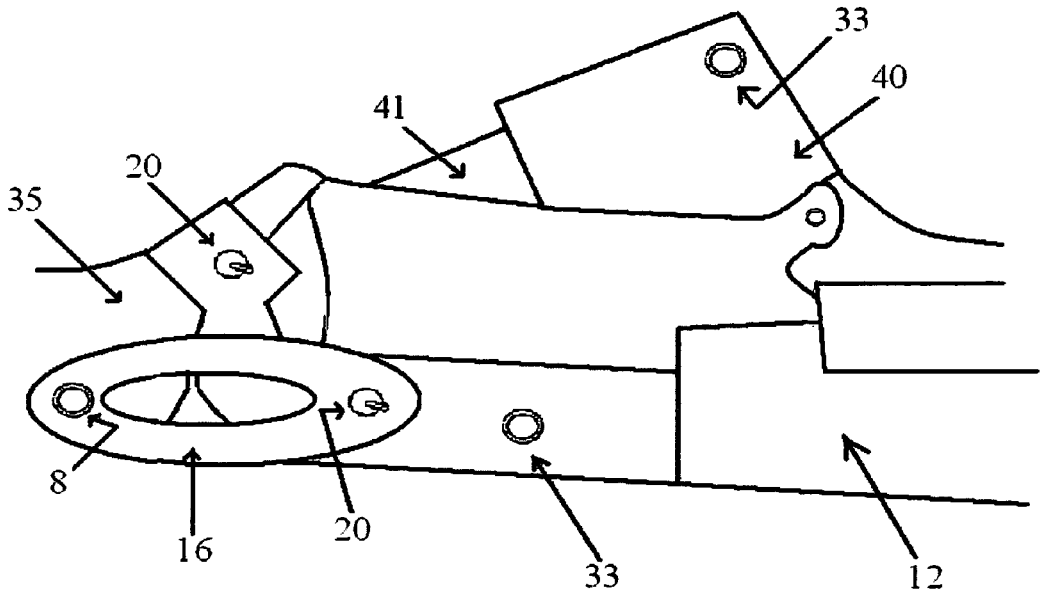
FIG. 47 is the illustrational view of the inside of shoe panels
Figure 48:
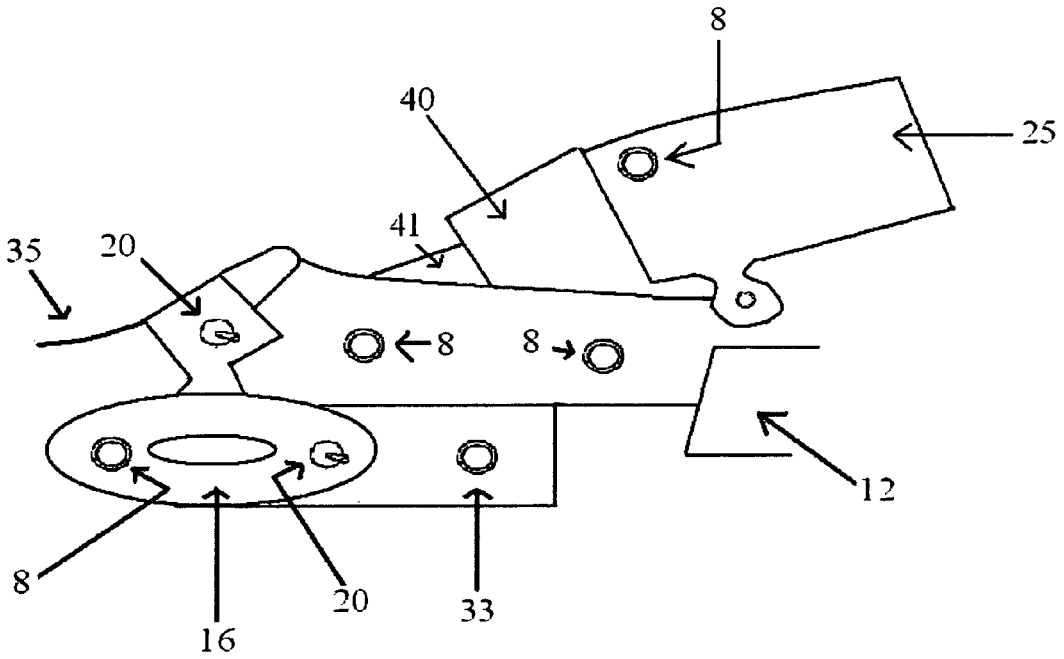
FIG. 48 is the illustrational view of the inside of shoe panels
Figure 49:
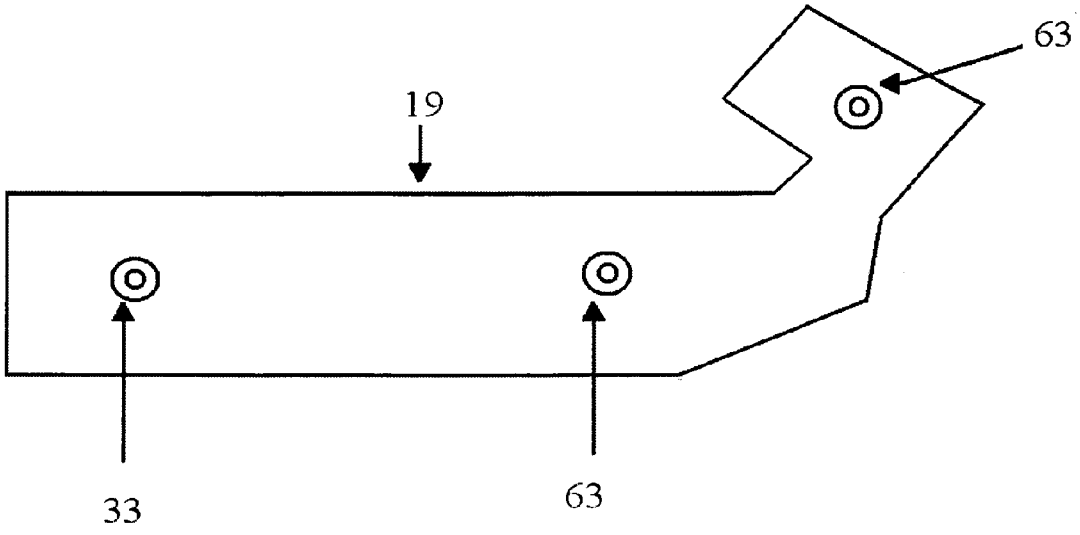
FIG. 49 is an illustrational view of the inside of shoe pocket storage panel left side
Figure 50:
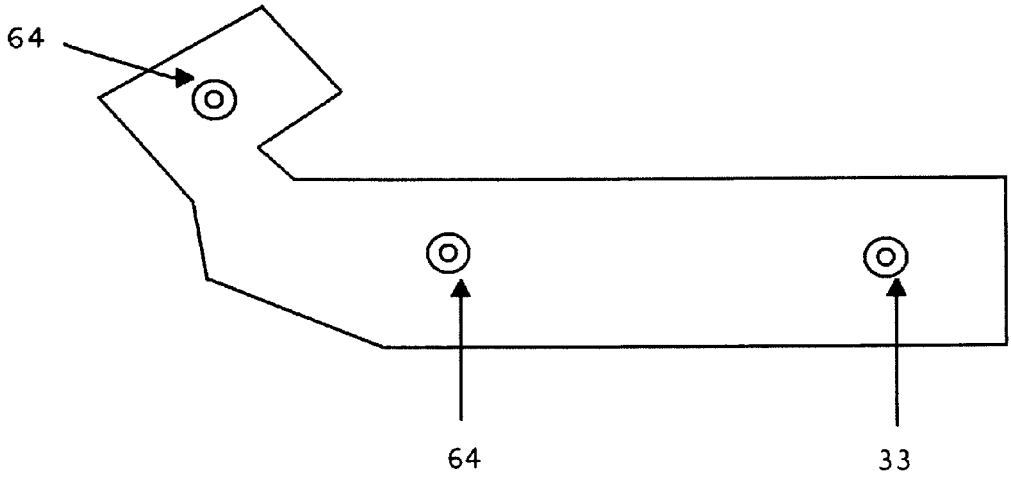
FIG. 50 is an illustrational view of the inside of shoe pocket storage panel right side FIG. 51 left circular rotating axle FIG. 52 right circular rotating axle
Figure 51:
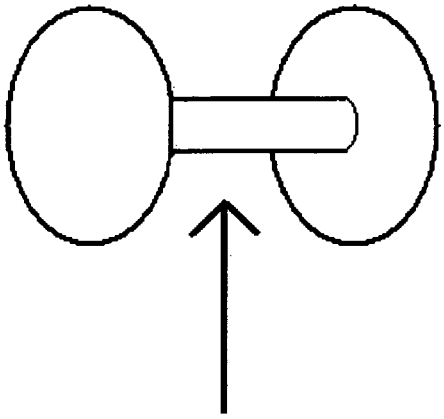
Figure 52:
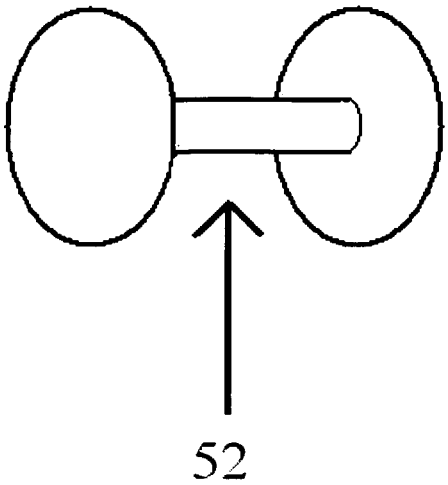
Figure 53:
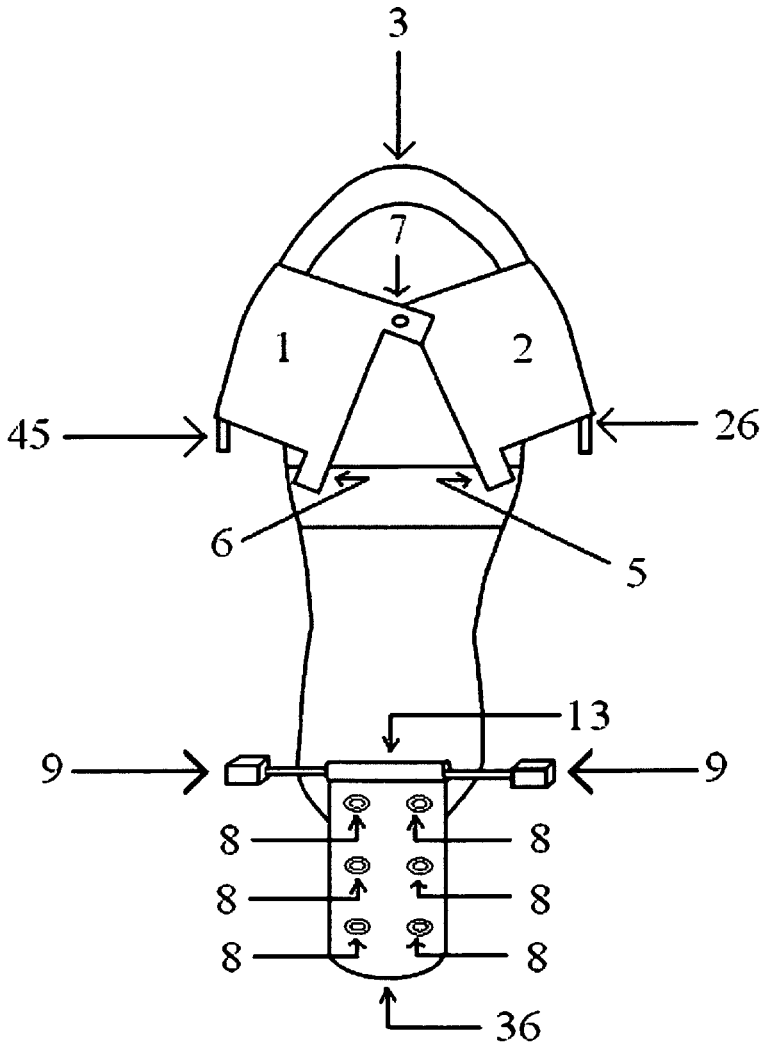
FIG. 53 is an inside perspective view of the bottom of the shoe showing the shoe drawers and tongue of the shoe in the functioning positions with the drawer of the shoe in an open position and the back tongue of shoe in the extended position
Figure 54:
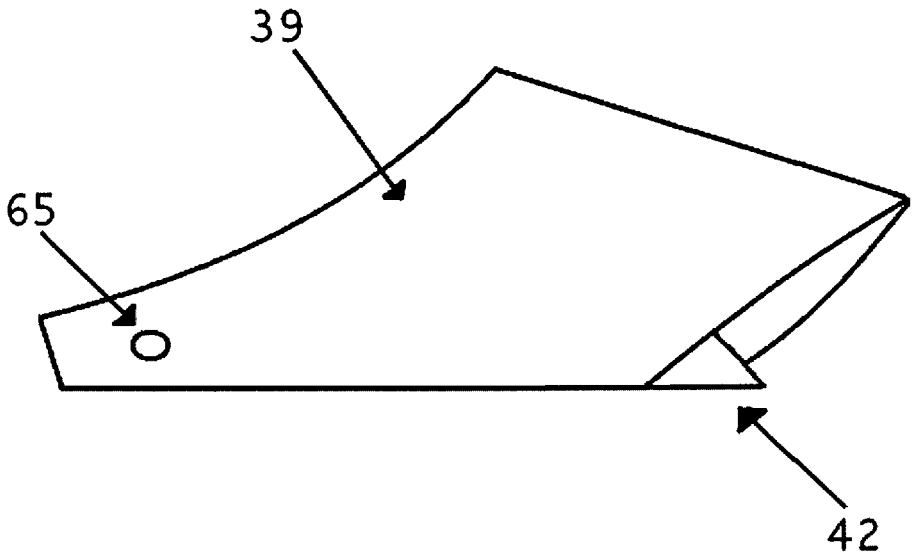
FIG. 54 is a left side illustrational view of the high-top trapezoid rotating side panel with right triangle high-top extension rotating panel in storage position
Figure 55:
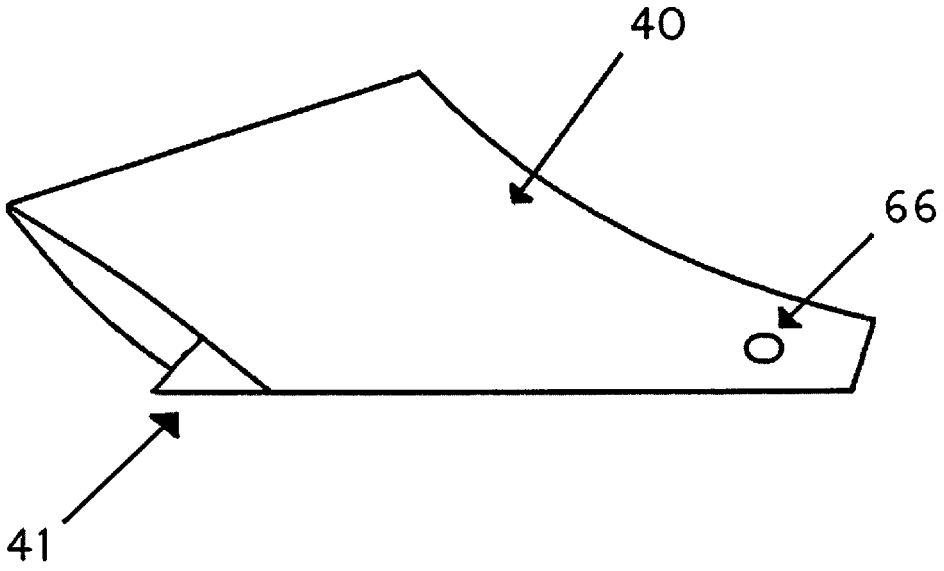
FIG. 55 is a right side illustrational view of the high-top trapezoid rotating side panel with right triangle high-top extension rotating panel in storage position
Figure 56:
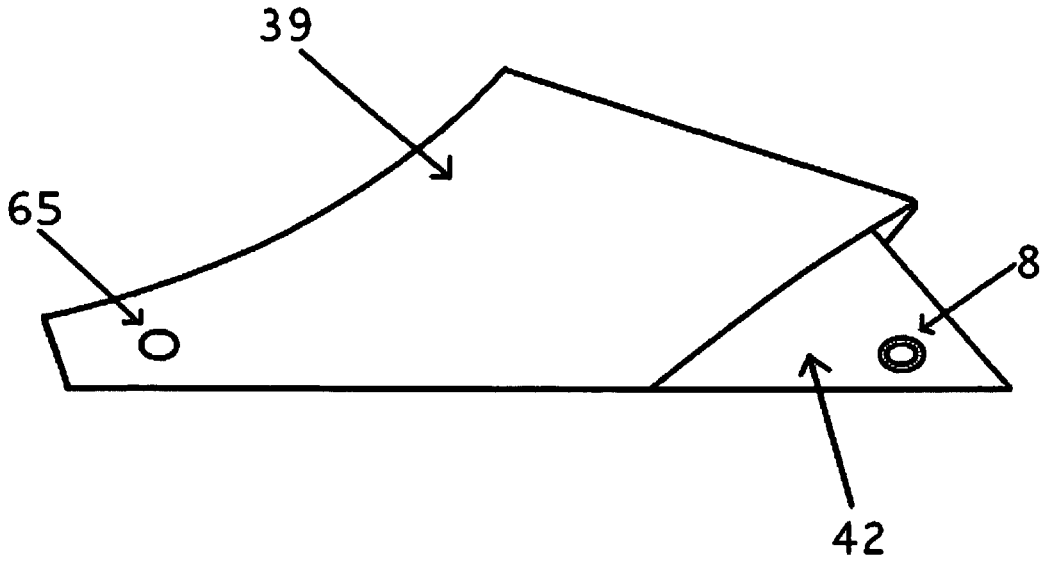
FIG. 56 is a left side illustrational view of the high-top trapezoid rotating side panel with right triangle high-top extension rotating panel in extended position
Figure 57:
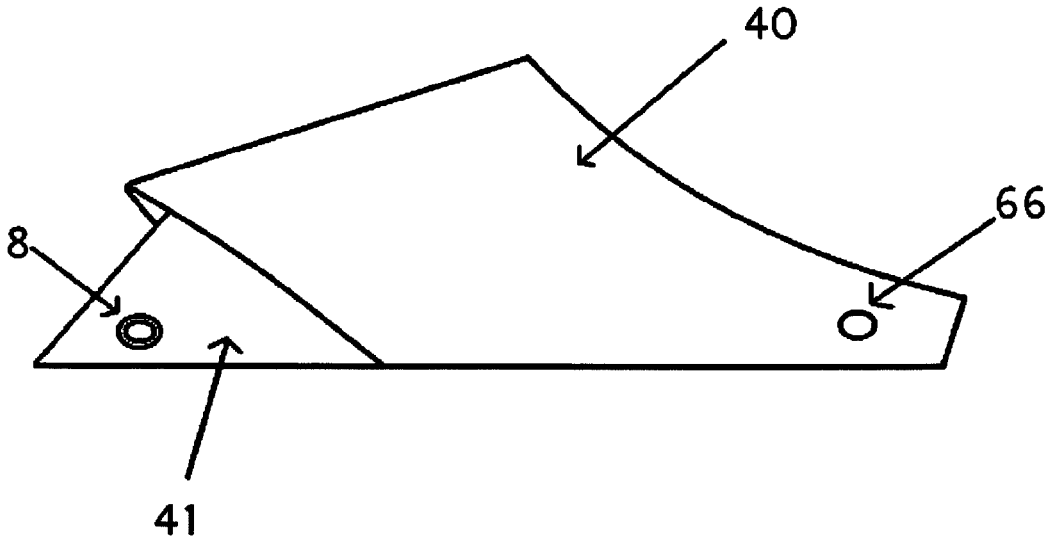
FIG. 57 is a right side illustrational view of the high-top trapezoid rotating side panel with right triangle high-top extension rotating panel in extended position
Figure 58:
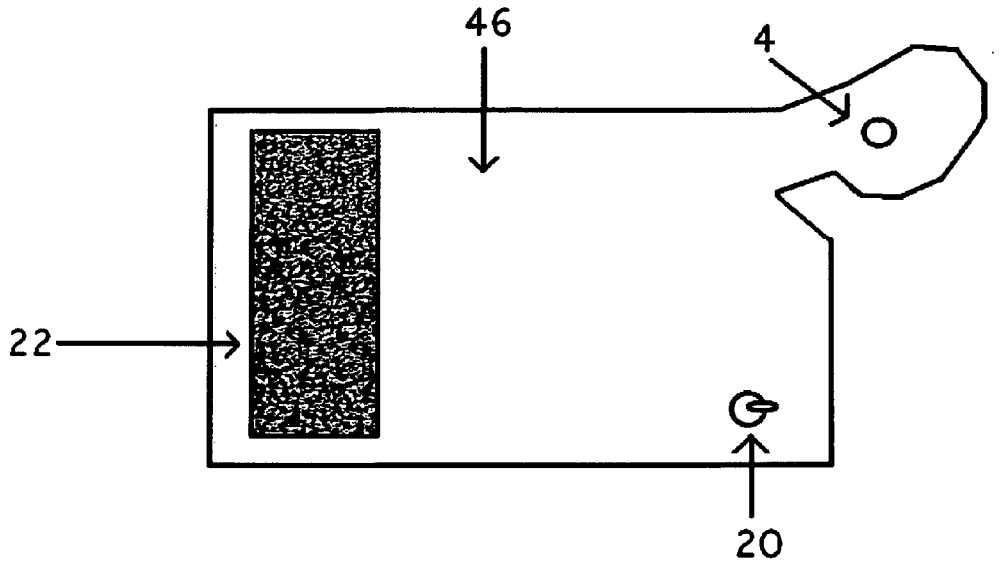
FIG. 58 is a front perspective view of the rotating front support panel
Figure 59:
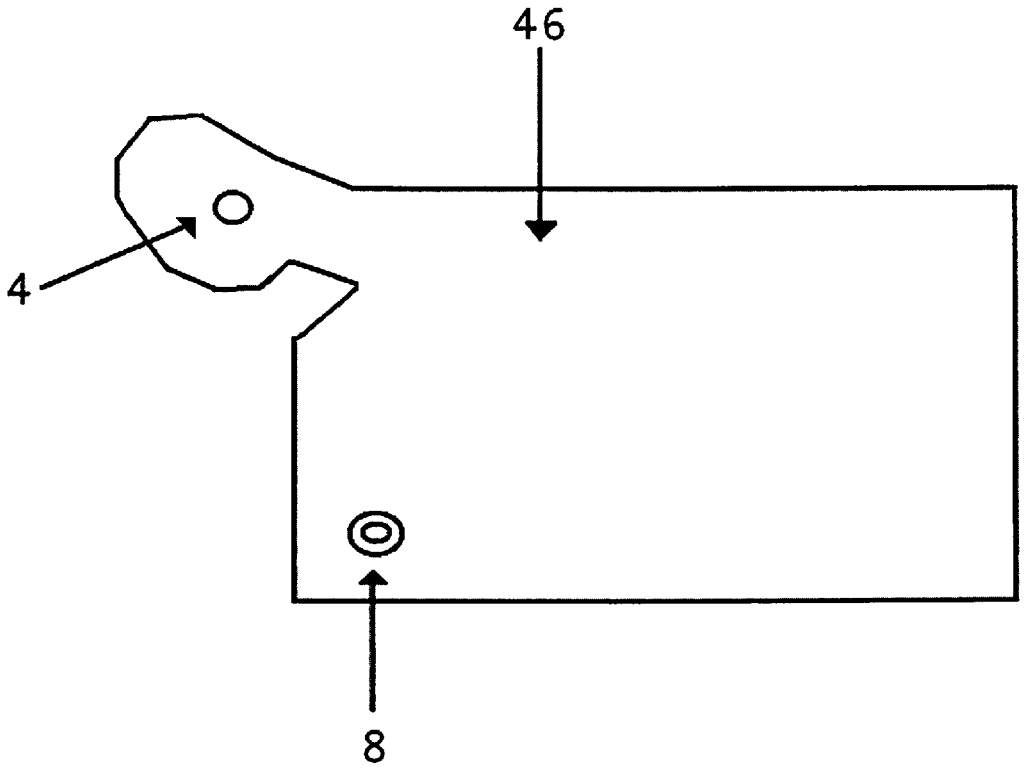
FIG. 59 is a back perspective view of the rotating front support panel
Figure 60:
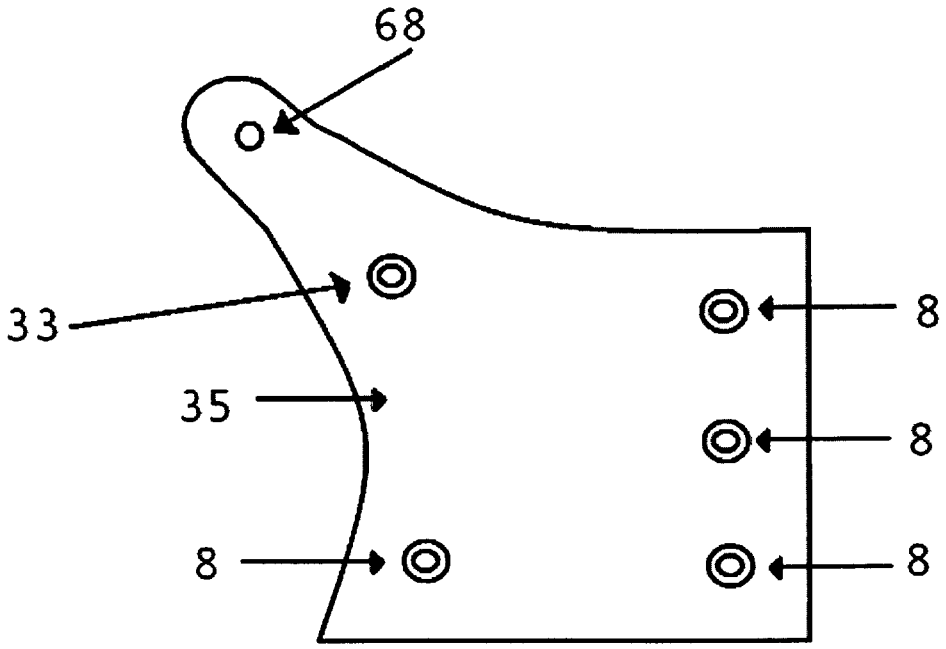
FIG. 60 is a back perspective view of the right side of the posterior rotating panel
Figure 61:
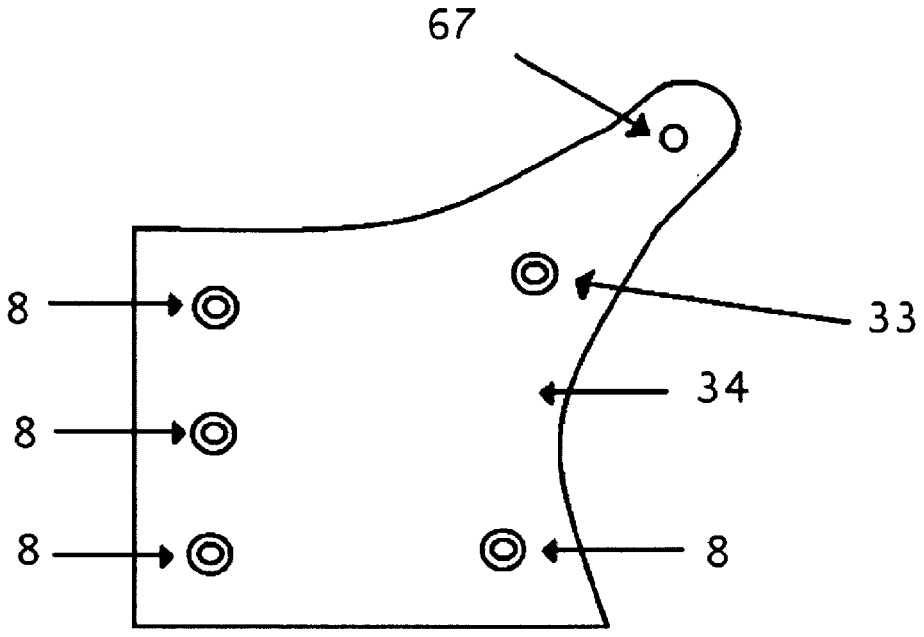
FIG. 61 is a back perspective view of the left side of the posterior rotating panel
Figure 62:
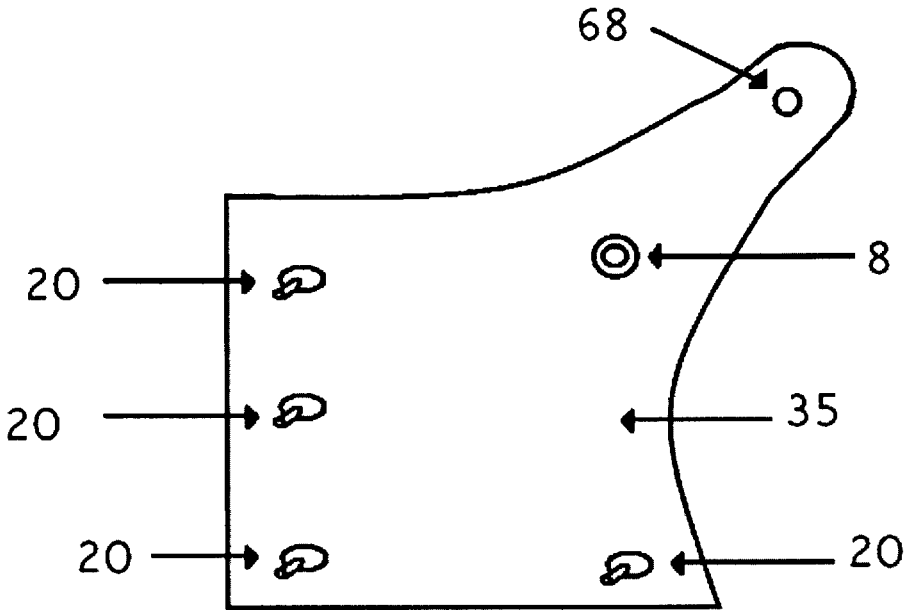
FIG. 62 is a front perspective view of the right side of the posterior rotating panel
Figure 63:
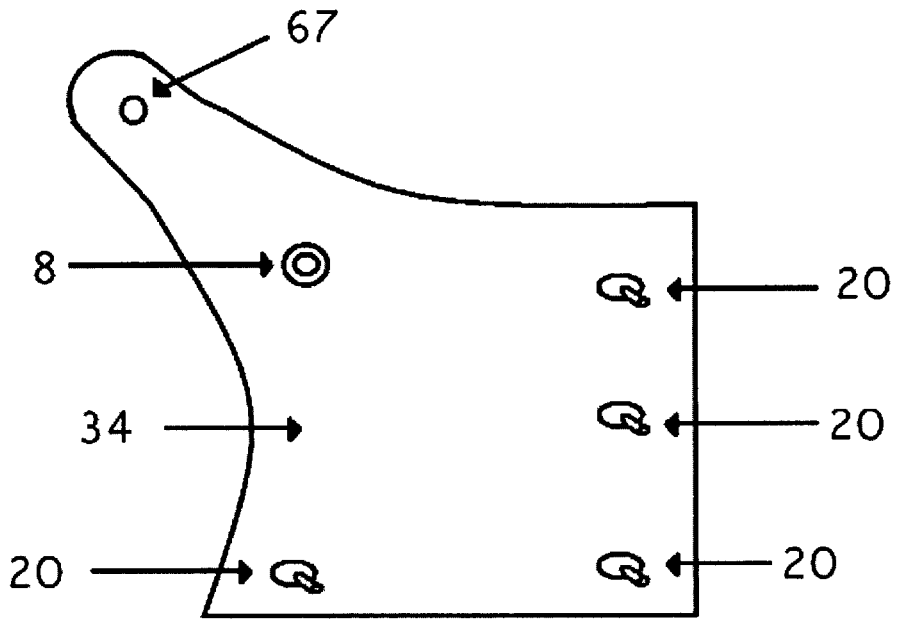
FIG. 63 is a front perspective view of the left side of the posterior rotating panel
Figure 64:
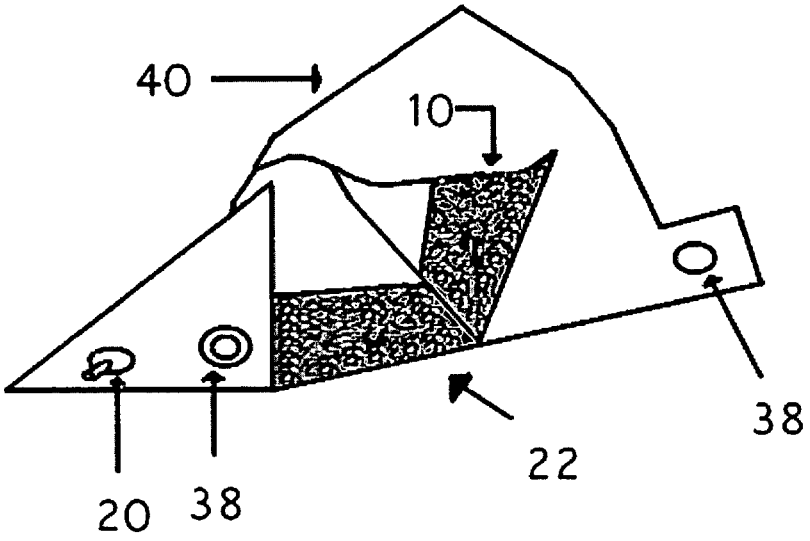
FIG. 64 is a cross sectional perspective view of the inside and outside view of the right side high-top trapezoid rotating side panel folded back showing the right triangle high-top extension rotating panel attachment and velcro attachments
Figure 65:
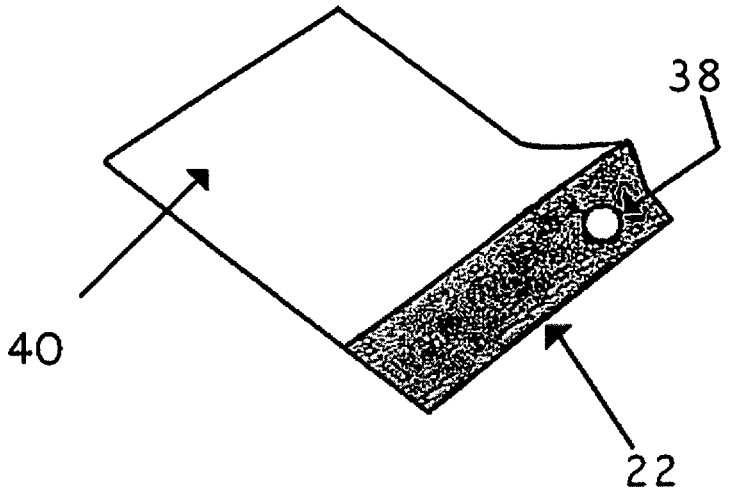
FIG. 65 is a left inside perspective view of the right side high-top trapezoid rotating side panel showing velcro attachments
Figure 66:
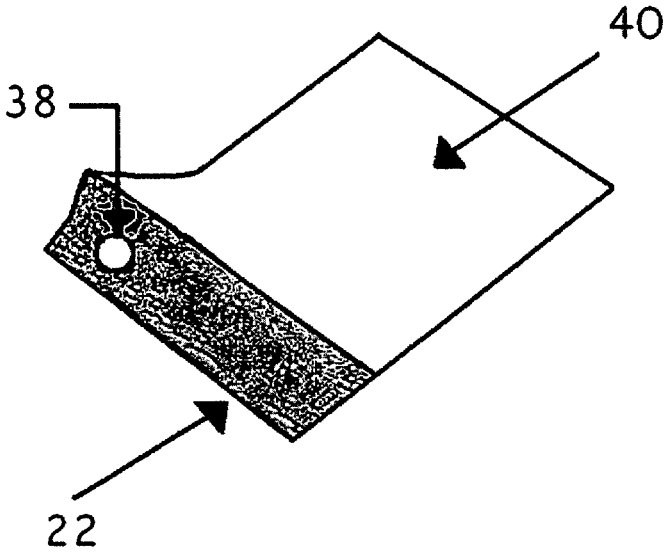
FIG. 66 is a right inside view of the right side high-top trapezoid rotating side panel showing the velcro attachments
Figure 67:
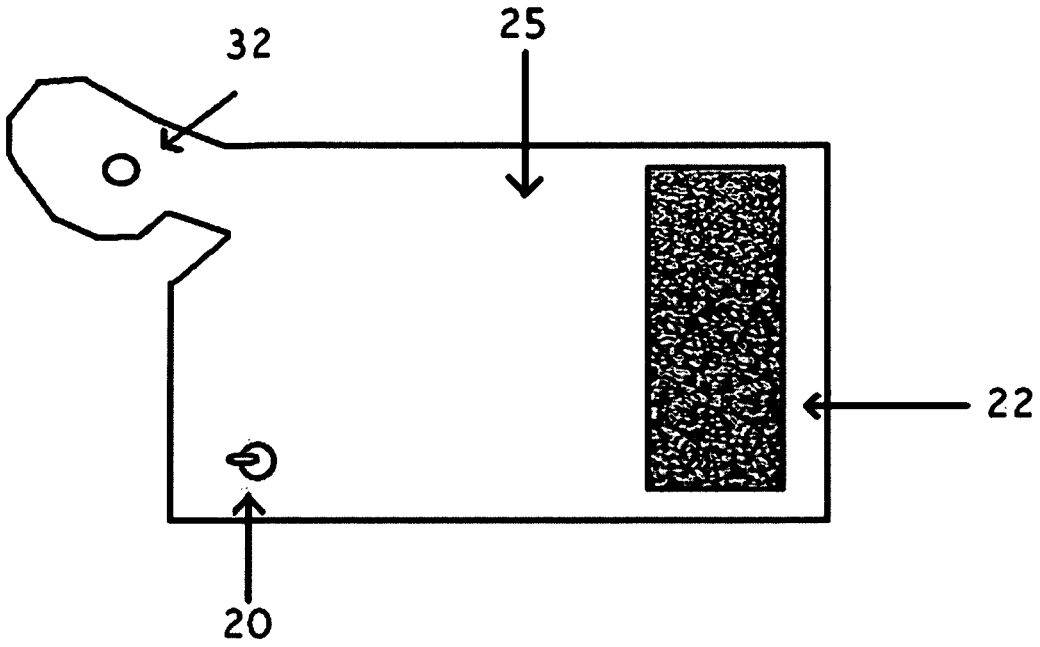
FIG. 67 is a front perspective view of the rotating front support panel
Figure 68:
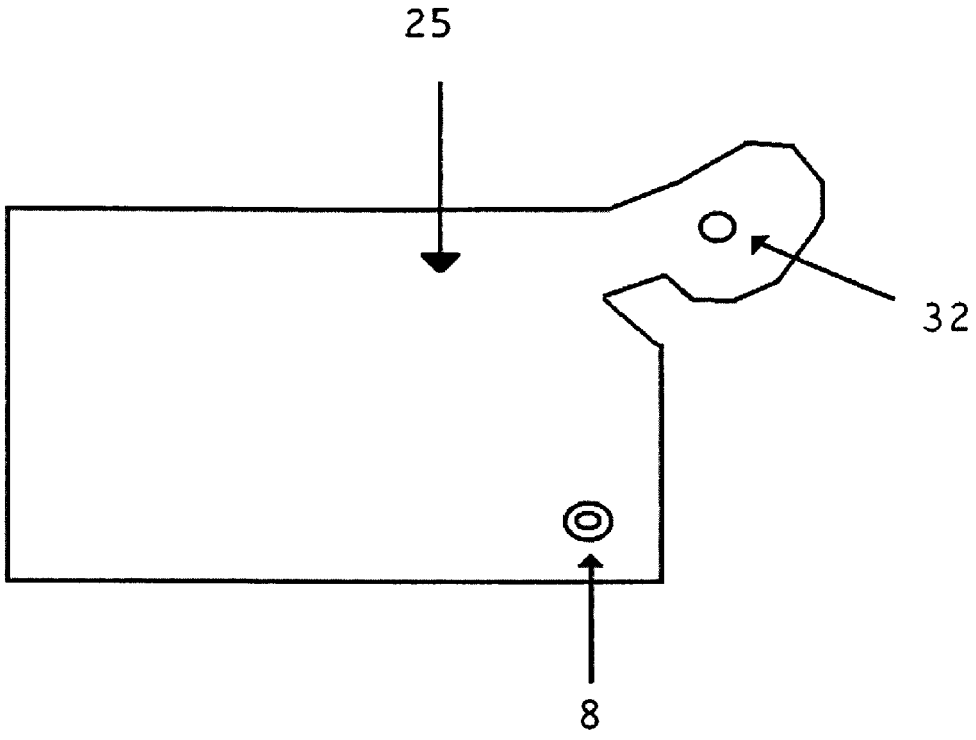
FIG. 68 is a back perspective view of the rotating front support panel
Figure 69:
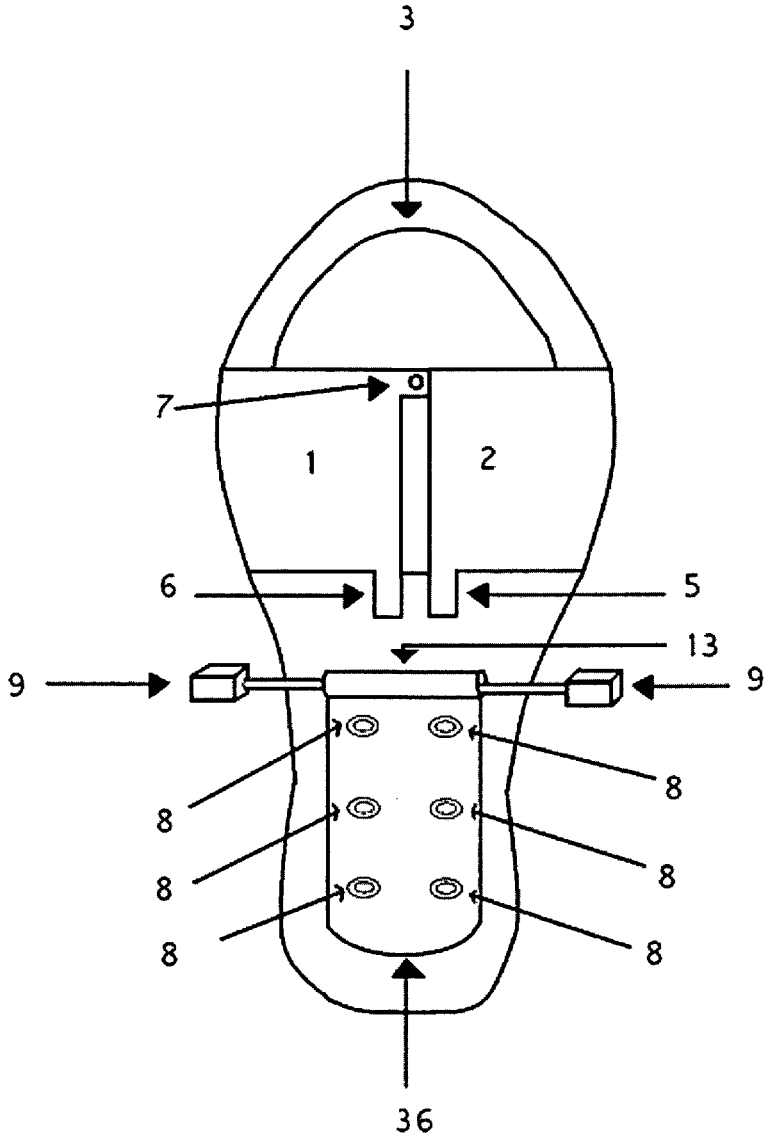
FIG. 69 is an inside perspective view of the bottom of the shoe showing the shoe drawers and back tongue of shoe in storage positions
Figure 70:
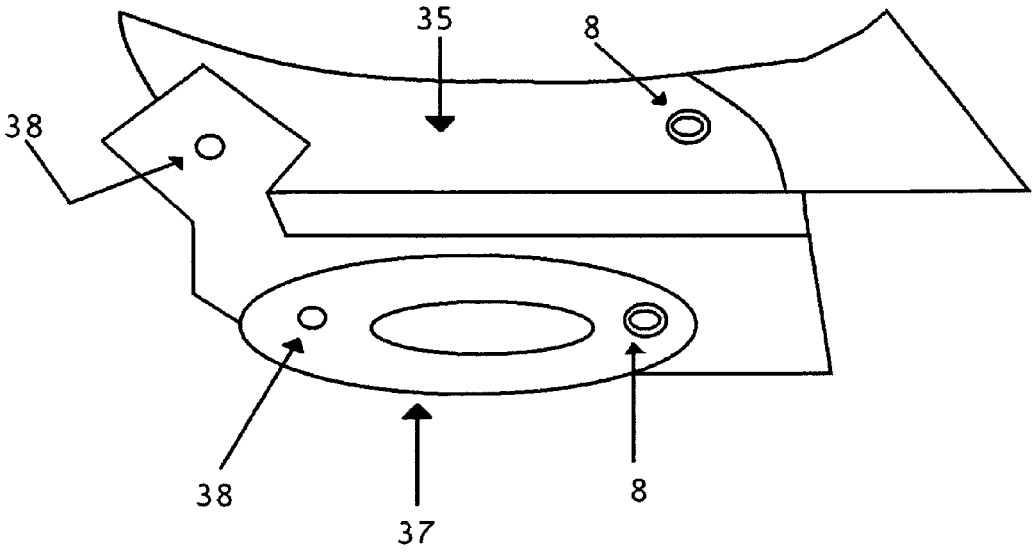
FIG. 70 is an inside cross sectional perspective view of the panels inside of the shoe
Figure 71:
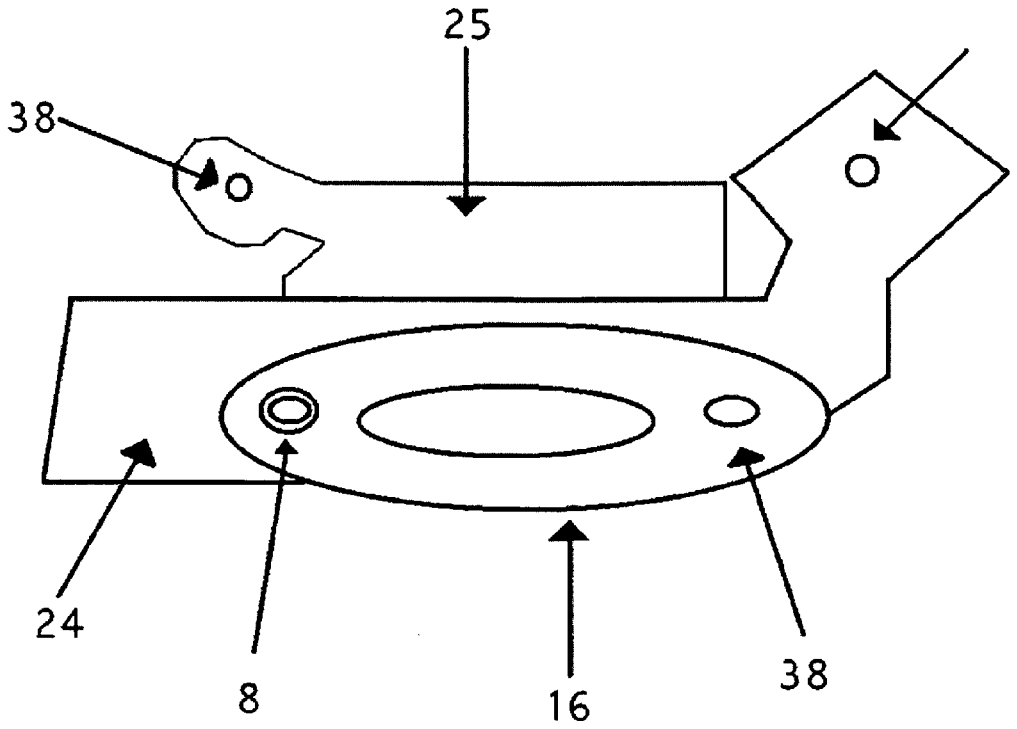
FIG. 71 is an inside cross sectional perspective view of the panels inside of the shoe
Figure 72:
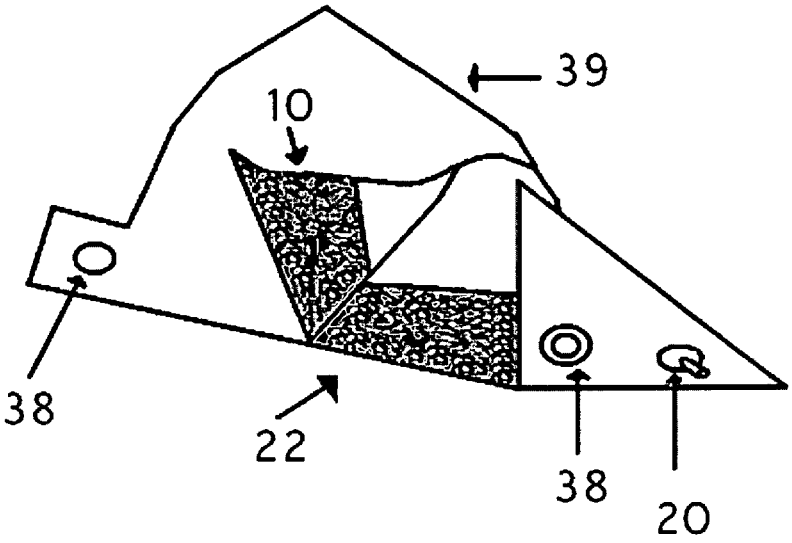
FIG. 72 is a cross sectional view of the inside and outside view of the left side high top side panel folded back showing the rotating triangle piece attached and velcro attachments
Figure 73:
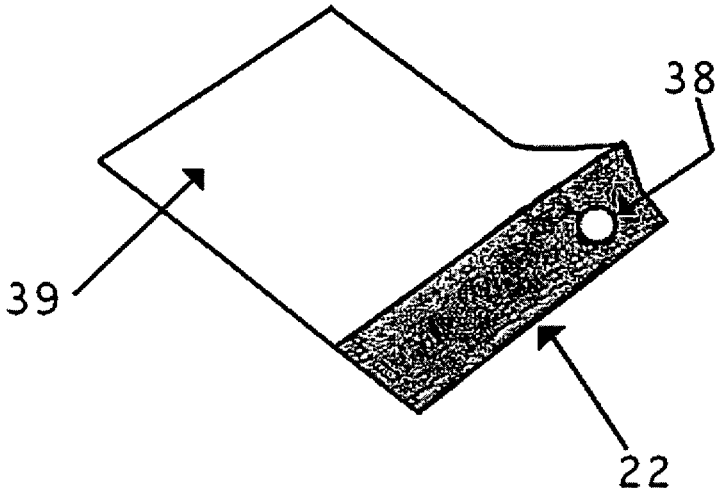
FIG. 73 is a left inside view of the right side high top rotating side panel showing velcro attachments
Figure 74:
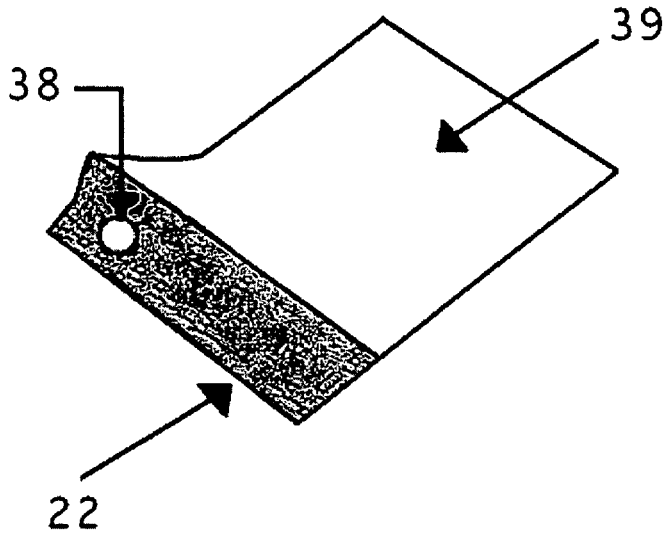
FIG. 74 is a right inside view of the right side high top rotating panel showing velcro attachment
Figure 75:
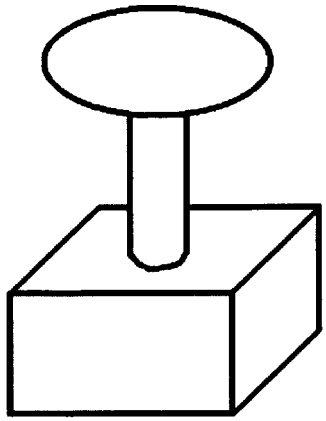
FIG. 75 is an illustrational view of the rod and end pieces axle that intersects through the rectangular rotating snap panel support bracket of the back of shoe bracket for the left side of the shoe
Figure 76:
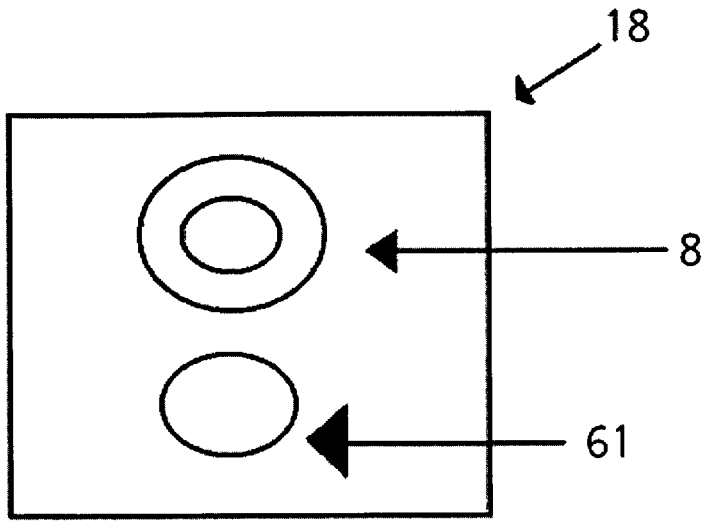
FIG. 76 is an illustrational view of the back of the rectangular rotating snap panel support bracket on back of the shoe for the left side of the shoe
Figure 77:
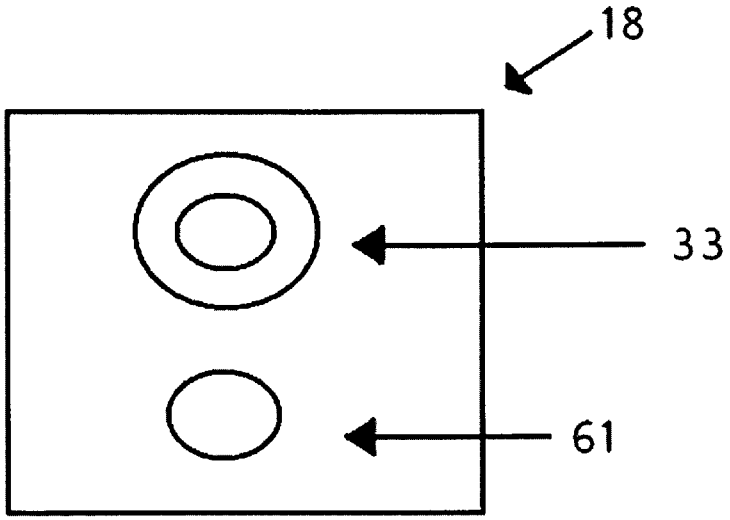
FIG. 77 is an illustrational view of the front of the rectangular rotating snap panel support bracket on the back of the shoe for the left side of the shoe
Figure 78:
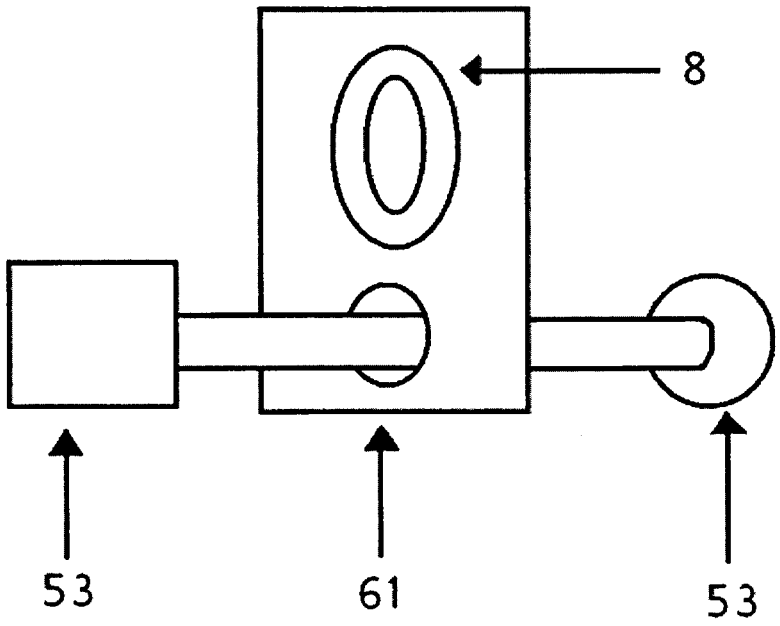
FIG. 78 is an illustrational view of the back of the rectangular rotating snap panel support bracket on the back of the shoe showing the intersection of the axle for the left side of the shoe
Figure 79:
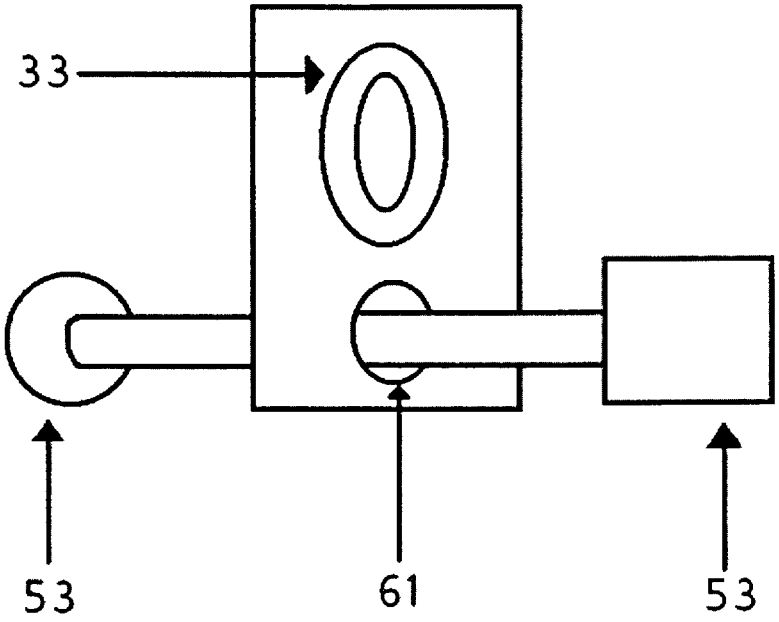
FIG. 79 is an illustrational view of the back of the rectangular rotating snap panel support bracket on the back of the shoe showing the intersection of the axle for the left side of the shoe
Figure 80:
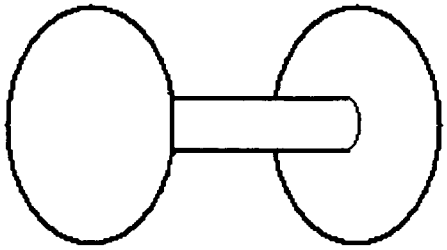
FIG. 80 is an illustrational view of the left side of the shoe rod axle on the inside of the shoe that intersects the rotating circular panel, and the inside of shoe pocket storage panel shows only the rod and not the panels that the rod intersects
Figure 81:
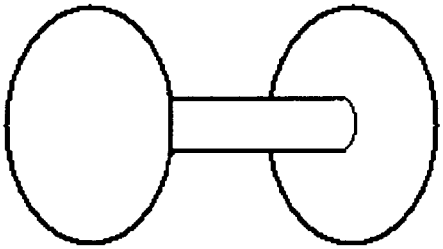
FIG. 81 is an illustrational view of the right side of the shoe rod axle on the inside of the shoe that intersects the rotating circular panel and the inside of shoe pocket storage panel shows only the rod and not the panels that the rod intersects
Figure 82:
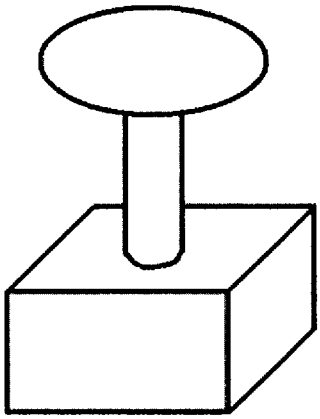
FIG. 82 is an illustrational view of the left side of shoe rod axle adjacent to the rectangular cutout in the middle of the heel of shoe that intersects the rotating rectangular snap panel and the back heel of shoe on the same rod axle that shows only the rod and not the panels that the rod intersects
Figure 83:
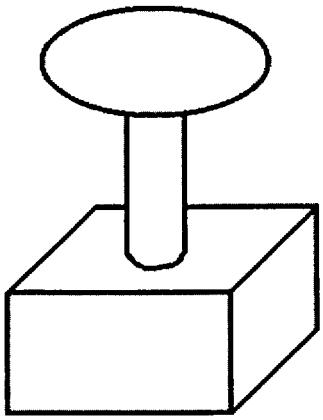
FIG. 83 is an illustrational view of the left side illustrational view of the high-top trapezoid rotating side panel with right triangle high-top extension rotating panel in storage position that shows only the rod and not the panels that the rod intersects
Figure 84:
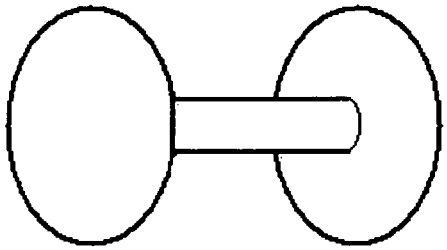
FIG. 84 is an illustrational view of the upper middle of the heel of shoe rod axle that intersects on the same rod axle through the left side (drawer panel number 2) and the right (drawer panel number 1) side of the shoe pivot drawers that shows only the rod and not the panels that the rod intersects
Figure 85:
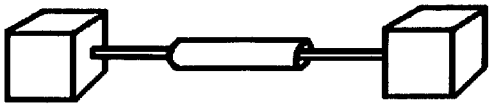
FIG. 85 is an illustrational view of the rod axle inside of shoe rectangular cut out that intersects on the same rod axle through the outside of the rectangular cut out along each side of the shoe, a loop in the bottom of the back tongue of the shoe and back through the rectangular cut out along the side of the shoe shows only the rod and not the panels that the rod intersects shows only the rod and not the panels that the rod intersects
Figure 86:
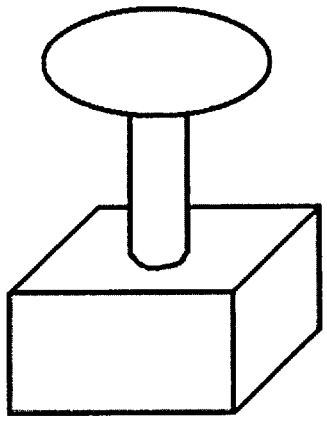
FIG. 86 is an illustrational view of the left shoe axle on the upper middle left side that intersects on the axle the panels left outside pocket storage panel; left high-top trapezoid rotating side panel; front high-top support panel; and at the top left side of the shoe top notch through eyelid holes in the panels that shows only the rod and not the panels that the rod intersects
Figure 87:
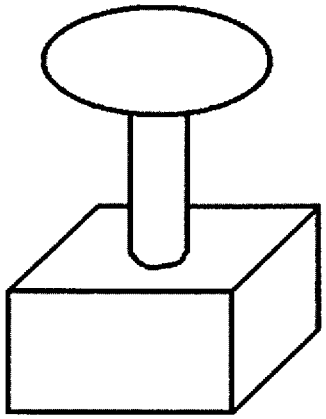
FIG. 87 is an illustrational view of the right shoe axle on the upper middle left side that intersects on the axle the panels left outside pocket storage panel; left high-top trapezoid rotating side panel; and at the top left side of the shoe top notch through eyelid holes in the panels that shows only the rod and not the panels that the rod intersects
Figure 88:
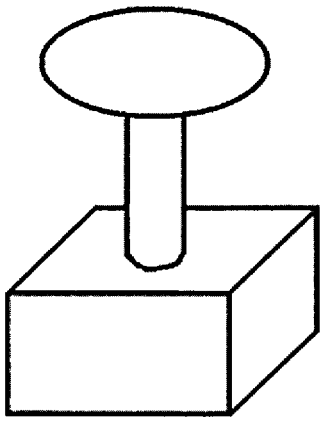
FIG. 88 is an illustrational view of the left shoe axle on the upper middle right side that intersects on the axle the panels right outside pocket storage panel; right high-top trapezoid rotating side panel; and at the top right side of the shoe top notch through eyelid holes in the panels that shows only the rod and not the panels that the rod intersects
Figure 89:
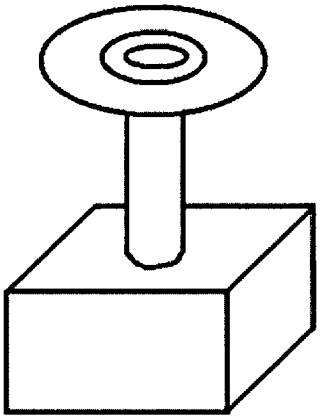
FIG. 89 is an illustrational view of the left side of shoe rod axle on the upper back of the shoe that intersects on the same rod axle the panels of the outer back tab of shoe on backside of shoe, inner pocket storage panel, and posterior rotating panel; for which, the end piece of the rod are a female snap member on one end of the rod that is inside of the shoe, and a square knob that is on the outside of the rod axle that shows only the rod and not the panels that the rod intersects
Figure 90:
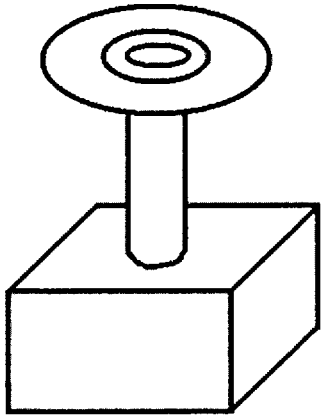
FIG. 90 is an illustrational view of the right side of shoe rod axle on the upper back of the shoe that intersects on the same rod axle the panels of the outer back tab on backside of shoe, inner pocket storage panel, posterior rotating panel; for which, the end piece of the rod are a female snap member on one end of the rod that is inside of the shoe, and a square knob that is on the outside of the rod axle that shows only the rod and not the panels that the rod intersects
Figure 91:
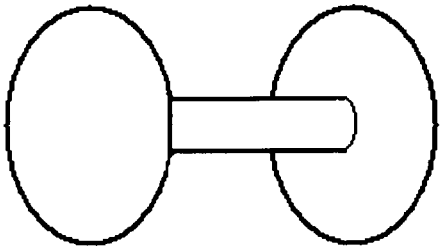
FIG. 91 is an illustrational view of the left side of shoe rod axle inside of the high-top trapezoid rotating side panel intersects the bottom angle of the right triangle high-top extension and the inner back of the high-top trapezoid rotating side panel that shows only the rod and not the panels that the rod intersects
Figure 92:
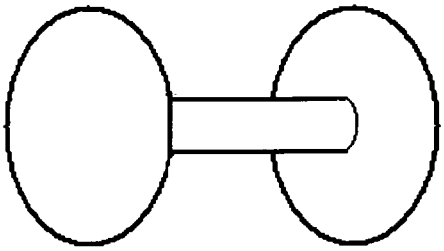
FIG. 92 is an illustrational view of the right side of shoe rod axle inside of the high-top trapezoid rotating side panel intersects the bottom angle of the right triangle high-top extension and the inner back of the high-top trapezoid rotating side panel that shows only the rod and not the panels that the rod intersects

The present invention is a transforming shoe that can be taken apart and converted from a low-top shoe to a high-top shoe; a high-top shoe to a low-top shoe; an open-back low-top shoe; a low-top shoe with an attached back strap; an open-back shoe with panels in an extended position; an open-back high-top shoe; a high-top shoe with an attached back strap; and an open-back high-top shoe with panels in an extended position; wherein the conversion of the transforming shoe can be a achieved by the included composition of two double rotating high-top trapezoid rotating side panels that snaps to the outside of the shoe on both sides; a rotating front high-top support panel; a sliding back tongue of shoe that slides along an open rectangular opening in the heel of the shoe that can connect by complimentary snap components to the two rotating posterior side panels.

A more detailed description of the present invention, transforming conversions; shall be, as follows:

The transforming shoe can achieve many different combinations; such as, the low top position with back extension can be achieved by rotating the rotating posterior rotating panels from the inner shoe pocket storage panel and then connecting with complimentary snap members on the inner panel of the back tongue of shoe to the extended ready to assemble position on the posterior end of the shoe. The back tongue of the shoe is pulled out of its' housed position in the hollow cavity, through a rectangular cut out in the upper back of the heel. The back tongue of the shoe is then, vertically, pulled up. Both the inner panel of the back tongue of shoe and two posterior rotating panels are connected together by complimentary snap member attachments, then to secure the posterior rotating panel, the rectangular rotating snap panel support bracket is rotated around to connect to complimentary snap member attachments onto the bottom of the posterior rotating panels. To further add security, the two rotating circular panels are removed from their storage snapped member location on the inner shoe storage pocket panel by the unsnapping of the snap member unit attached to its' complimentary component and then rotating into an out of storage position to complimentary snap member attachments on the inner side of the posterior rotating side panel. The following above instructional steps, conclude the assembly of the closed back of the shoe. In further understanding, of the transformation of the position, low-top shoe with full back panel extension, also in this combination is the conversion of a high top shoe to a low top shoe where the two high-top trapezoid rotating side panels and the right angle triangle high-top extension rotating panel are disassembled. The right angle triangle high-top extension rotating panel is disassembled by rotating the extending rotating triangular panel in an upright angle position with the right side edge attached by complimentary velcro attachments to inside of the high-top trapezoid rotating side panel. This position hides the rotating right angle triangle high-top extension rotating panel from outside view. The two high-top trapezoid rotating side panel is then rotated down into storage position in the outside pocket storage panel on the outer sides of the shoe. In conclusion and in combination, with the transformation conversion of the closed full extended back of shoe; the position of low-top shoe with full back extension is created.

The low top shoe position with absent back of shoe can be achieved by disassembling the full extended back panel of shoe position by detaching the complimentary snap attachments on the rotating posterior rotating panels and the inner back of tongue. Once these two panels are disassembled, each one are returned to their housed storage positions. The back of tongue slides into a rectangular cut out into the upper back heel of the shoe which leads into a rectangular cavity and each side posterior rotating panels are rotated towards the inside of the shoe into a storage position in the inner shoe pocket storage panel. The following above instructional steps, conclude the assembly of the absent back of shoe. In further understanding, of the transformation of the shoe position, low-top shoe with full back extension also, in this combination is the conversion of a high-top shoe to a low-top shoe where assembly for a low top shoe position; shall be, as described and stated above. In conclusion and in combination, with the transformation conversion of the low-top position and absent back of shoe position, the position of the low-top position with absent back of shoe is created.

The high-top shoe position with full back extension position can be achieved by rotating the high-top trapezoid rotating side panel up from its' storage position in the outside pocket storage panel. The high-top trapezoid rotating side panel is then opened by separating the velcro attachments and then rotating the extending rotating right angle triangle high-top extension rotating panel into its' extended visible position to outside of the high-top trapezoid rotating side panel view. Once the rotating right angle triangle high-top extension rotating panel is placed into its' extended position, both the right angle triangle high-top extension rotating panel and the high-top trapezoid rotating side panel are attached to the upper outer side of the shoe by means of complimentary snap member attachments. The front high-top support panel is then rotated in an upward direction from its' housed position. The front high-top support panel is then on each side edge attached to each respective complimentary side panel of the high-top trapezoid rotating side panel by complimentary snap member attachments on one side and complimentary velcro attachments on the other side. The, following, above instructional steps, conclude the assembly of the high top panel of shoe. In further understanding, of the transformation of the shoe position high top with full back extension, also, in this combination, is the conversion of an absent back of shoe where assembly; shall be as, described and stated above.

The high-top shoe position with absent back of shoe can be achieved by the assembly of, as stated above, for the conversion of a high-top shoe position and the conversion of a full back shoe to an absent back of shoe. These two conversions together create the transforming conversion of a high top position shoe with absent back of shoe. Both the high-top shoe position and the low-top shoe position of absent back of shoe have the option of the attachment of a detachable scrap, the detachable scrap is housed in its' storage position affixed by complimentary snap member attachments to the bottom edge of the heel of the shoe on the posterior end of the shoe. When ready, for use, the detachable scrap can be detached from the storage position on the heel of the shoe and then connected to the inner rotating complimentary snap member attachments on the rotating posterior panel of the shoe.

The present invention of the transforming shoe has storage capability for storage items in the heel of shoe pivot in and out drawers on each side of the shoe.

What is claimed as the invention is:

1. A multi-functional transforming shoe that is taken apart and reassembled in a high-top shoe configuration, a low-top shoe configuration, and an open-back configuration with a strap attachment, the shoe comprising:

a) two high-top trapezoid rotating side panels (39, 40) comprising a right panel (40) and a left panel (39);

b) a sliding back tongue (36) that slides along an open rectangular opening (17) in a middle side and a middle back heel portion of the shoe by sliding a rod axle (9);

c) a detachable heel strap (27) with a storage resting position on a back heel portion of the shoe that is attached to a complementary female snap member (33) at a top of each of two posterior rotating panels (34, 35), comprising a right panel (34) and a left panel (35), on a rod axle (47, 48) that intersects the posterior rotating panels when the panels are in a non-extended storage position, wherein said posterior rotating panels affix to complementary snap members (8) on the sliding back tongue (36);

d) two pivot heel drawers (1, 2) with tab snap closures (45, 26), wherein the two pivot heel drawers comprise a right drawer (1) and a left drawer (2);

e) a rotating front high-top support panel (25, 46) that attaches to both sides of the high-top trapezoid rotating side panels (39, 40), wherein the panels are attached by attachment means comprising complementary female (33) and male (20) snap members, a rod axle (14, 15) on one side, and complementary hook-and-loop (22) members on another side;

f) two inside-of-shoe pocket storage panels (19, 24), comprising a right panel (24) and a left panel (19), for storage of the two posterior rotating panels;

g) two outside-of-shoe pocket storage panels (21, 23), comprising a right panel (21) and a left panel (23), for storage of the two posterior rotating panels;

h) two outer support rectangular rotating snap panels (18) located adjacent opposing sides of the open rectangular opening (17);

i) inside-of-shoe female snap members (33) attached to an end of the rod axle (47, 48) that intersects the posterior rotating panels (34, 35), inside-of-shoe pocket storage panels (19, 24), and an upper back tab (28, 29), wherein the upper back tab is detachably attached to the detachable heel strap (27) by complementary snap members (33, 20);

j) two triangular high-top extension rotating panels (41, 42), comprising a right panel (41) and a left panel (42); wherein the triangular high-top extension rotating panels are housed inside of the high-top trapezoid rotating side panels (39, 40); wherein the triangular high-top extension rotating panels and the high-top trapezoid rotating side panels are connected by a rod axle (49, 50) that intersects both the triangular high-top extension rotating panels and the high-top trapezoid rotating side panels on each side of the shoe;

k) two inside-of-shoe rotating circular support panels (16, 37) comprising a right panel (16) and a left panel (37); and l) eyelet holes (55-68) for lace attachments.

2. The transforming shoe of claim 1, wherein the two high-top trapezoid rotating side panels (39, 40) are disposed at a top portion of right and left sides of the shoe;

wherein each high-top trapezoid rotating side panel comprises a shape of a double layer trapezoid connected together by thread stitching at a top edge and one side edge of the panel, thus leaving a bottom edge and another side edge open;

wherein the two triangular high-top extension rotating panels (41, 42) and the high-top trapezoid rotating side panels are intersected by a rod axle (14, 15) such that the rod axle extends through eyelet holes (55, 56) disposed in the triangular high-top extension rotating panels (41, 42) and through eyelet holes (65, 66) disposed in the high-top trapezoid rotating side panels (39, 40), wherein the rod axle (14, 15) comprises an ornamental square attachment at one end thereof and a flat circular attachment on another end thereof; and wherein the rod axle (14, 15) also intersects the outside-of-shoe pocket storage panels (21, 23) and the rotating front high-top support panel (25, 46).

3. The transforming shoe of claim 1, wherein the two triangular high-top extension rotating panels (41, 42) are formed in a shape of a right triangle;

wherein the triangular high-top extension rotating panels (41, 42) and the high-top trapezoid rotating side panels (39, 40) are connected by means of complimentary hook-and-loop (22) members;

wherein the triangular high-top extension rotating panels (41, 42) rotate within the high-top trapezoid rotating side panels (39, 40) by means of a rod axle (14, 15);

wherein the triangular high-top extension rotating panels (41, 42) comprise a male snap member (20) in one corner of the triangle, and a hook-and-loop member (22) disposed along an edge above an eyelet hole (55, 56) in another corner thereof; wherein the hook-and-loop member enhances the stability of the triangular high-top extension rotating panels; and wherein the high-top trapezoid rotating side panels (39, 40) are stored in the outside-of-shoe pocket storage panels (21, 23).

4. The transforming shoe of claim 1, the rotating front high-top support panel (25, 46) is rectangular in shape;

wherein the rotating front high-top support panel (25, 46) for a left and a right shoe are flipped mirror images of one another; and wherein the rotating front high-top support panel (25, 46), the high-top trapezoid rotating side panels (39, 40), and the inside-of-shoe rotating circular support panels (16, 37) are intersected by a rod axle (14, 15).

5. The transforming shoe of claim 1, wherein the two pivot heel drawers (1, 2) are housed in a cavity located in an anterior middle portion of the shoe; wherein both the pivot heel drawers (1, 2) and the tab snap closures (45, 26) are rectangular in shape; wherein the pivot heel drawers (1, 2) are intersected by the same rod axle (7).

6. The transforming shoe of claim 1, wherein the sliding back tongue (36) is substantially rectangular in shape with a curved top edge and comprises a loop (13) for receiving a rod axle (9) which comprises ornamental square end pieces on each end thereof;

wherein the sliding back tongue (36) comprises substantially parallel female snap on opposing sides thereof; and wherein the open rectangular opening (17) that houses the sliding back tongue (36) is defined by walls forming a top, bottom, and backside thereof.

7. The transforming shoe of claim 1, wherein the two posterior rotating panels (34, 35) and the two inside-of-shoe pocket storage panels (19, 24) are intersected by a rod axle (51, 52); wherein the rod axle (51, 52) comprises an ornamental square attachment at an outer end thereof and a rotating female snap member (33) on an inner end thereof;

wherein the two posterior rotating panels (34, 35) are substantially rectangular in shape with a concave curved top edge, and each comprise four male snap members (20), wherein three of the male snap members are disposed along a straight edge thereof and one male snap member is disposed along the curved top edge.

8. The transforming shoe of claim 1, wherein the two outer support rectangular rotating snap panels (18) comprise a male snap member (20) on one end thereof and an eyelet hole (61, 62) on an opposite thereof, wherein the eyelet holes are intersected by a rod axle (9) that connects the outer support rectangular rotating snap panels (18) to a back heel portion of the shoe;

wherein the outer support rectangular rotating snap panels (18) rotate downwards to snap onto the back heel portion for storage and rotate upwards to snap onto a bottom portion of the two posterior rotating panels (34, 35) to provide back support for the shoe.

9. The transforming shoe of claim 1, wherein the open rectangular opening (17) further comprises a middle opening, two opposing side openings, and walls formed therebetween, wherein said walls prevent the sliding back tongue (36) from sliding beyond a loop (13) located on a bottom edge of the sliding back tongue.

10. The transforming shoe of claim 1, further comprising rod axles (7, 14, 15, 43, 44, 47-54), wherein the rod axles comprise ornamental square end pieces on each end thereof.

11. The transforming shoe of claim 1, wherein the two pivot heel drawers (1, 2) are intersected by the same rod axle (7).

12. The transforming shoe of claim 1, wherein the detachable heel strap (27) comprises male snap members (20) disposed on both ends thereof and a female snap member (33) disposed on a middle portion thereof; wherein the detachable heel strap (27) attaches to right (28) and left (29) tabs on the back heel portion of the shoe to form an open-back configuration with a strap attachment.

13. The transforming shoe of claim 1, wherein the two inside-of-shoe pocket storage panels (19, 24) comprise eyelet holes (63,64) for insertion of a rod axle (51, 52) that intersects the two inside-of-shoe rotating circular support panels (16, 37) and the two inside-of-shoe pocket storage panels (19, 24), wherein the rod axle (51, 52) further comprises flat circular attachments on each end thereof;

wherein the inside-of-shoe rotating circular support panels (16, 37) attach by complementary snap members (33, 20) alternately to the posterior rotating panels (34, 35) to provide side support for the shoe when the posterior rotating panels are in an extended position, or to the two inside-of-shoe pocket storage panels (19, 24) when the posterior rotating panels are in a stored position.

14. The transforming shoe of claim 1, wherein the inside-of-shoe rotating circular support panels (16, 37) each comprise a female snap member (33) and eyelet holes (63,64) for insertion of a rod axle (51, 52) that intersects the two inside-of-shoe rotating circular support panels (16, 37) and the two inside-of-shoe pocket storage panels (19, 24).

15. The transforming shoe of claim 1, wherein the two outside-of-shoe pocket storage panels (21, 23) are substantially rectangular in shape with an upward extension and comprise eyelet holes (57, 58) for insertion of a rod axle (14, 15), wherein the rod axle (14, 15) comprises an ornamental square attachment at one end thereof and a flat circular attachment on another end thereof;

wherein the outside-of-shoe pocket storage panels (21, 23) are sewn by thread to an outside of the shoe along a side and a bottom edge thereof, thus leaving a top edge open.

16. The transforming shoe of claim 1, wherein the same rod axle (14, 15) intersects the outside-of-shoe pocket storage panels, the high-top trapezoid rotating side panels (39, 40), and the rotating front high-top support panel (25, 46).

17. The transforming shoe of claim 1, wherein the open rectangular opening (17) further comprises a rectangular middle opening and two opposing rectangular side openings.

18. The transforming shoe of claim 1, wherein the high-top trapezoid rotating side panels, posterior rotating panels, pivot heel drawers; tab snap closures; rotating front high-top support panel; inside-of-shoe pocket storage panels; outside-of-shoe pocket storage panels; triangular high-top extension rotating panels; inside-of-shoe rotating circular support panels form flip mirror images across a right to a left side of the shoe.

* * * * *